US006932543B2

(12) United States Patent
Kim

(10) Patent No.: US 6,932,543 B2
(45) Date of Patent: Aug. 23, 2005

(54) WEDGE ASSEMBLY AND INTERNAL ANCHORAGE USING THE SAME

(75) Inventor: Kuk-Il Kim, Gimpo-si (KR)

(73) Assignee: Samwoo Geotech. Co., Seoul (KR)

( * ) Notice: Subject to any disclaimer, the term of this patent is extended or adjusted under 35 U.S.C. 154(b) by 23 days.

(21) Appl. No.: 10/470,054

(22) PCT Filed: Mar. 21, 2002

(86) PCT No.: PCT/KR02/00479

§ 371 (c)(1),
(2), (4) Date: Jul. 24, 2003

(87) PCT Pub. No.: WO02/077372

PCT Pub. Date: Oct. 3, 2002

(65) Prior Publication Data

US 2004/0076480 A1 Apr. 22, 2004

(30) Foreign Application Priority Data

| | | |
|---|---|---|
| Mar. 23, 2001 | (KR) | 2001/15335 |
| May 25, 2001 | (KR) | 2001/15539 |
| May 15, 2001 | (KR) | 2001/26495 |
| Dec. 17, 2001 | (KR) | 2001/80183 |
| Dec. 17, 2001 | (KR) | 2001/80184 |

(51) Int. Cl.[7] ..... E02D 5/80; E21D 21/00
(52) U.S. Cl. ..... 405/259.4; 405/259.1
(58) Field of Search ..... 405/259.4, 259.1

(56) References Cited

U.S. PATENT DOCUMENTS

| | | | | |
|---|---|---|---|---|
| 4,132,498 A | | 1/1979 | Ikeda et al. | |
| 4,343,122 A | | 8/1982 | Wlodkowaki et al. | |
| 5,556,233 A | * | 9/1996 | Kovago | 405/259.4 |
| 6,146,055 A | * | 11/2000 | White | 405/259.4 |

FOREIGN PATENT DOCUMENTS

| | | |
|---|---|---|
| JP | 59-10614 A | 1/1984 |
| JP | 10-306440 A | 11/1998 |
| KR | 1993-18240 U | 8/1993 |
| KR | 1998-72170 A | 10/1998 |
| KR | 2000-39990 A | 7/2000 |
| WO | WO 95-23896 A1 | 9/1995 |

* cited by examiner

*Primary Examiner*—Frederick L. Lagman
(74) *Attorney, Agent, or Firm*—Robert E. Bushnell, Esq.

(57) ABSTRACT

In an internal anchorage wedge assembly, a tension member is removed by the release of a wedge engagement corresponding to external anchoring of the tension member in imposing the anchoring load on the tension member anchored to an underground anchor hole. Moreover, in the internal anchorage wedge assembly, the tension member is more simply and efficiently removed without removing any other equipment, such as a drawbench.

10 Claims, 22 Drawing Sheets

WEDGE ASSEMBLY AND INTERNAL ANCHORAGE USING THE SAME

TECHNICAL FIELD

The present invention relates to a wedge assembly for removing a tension member by the release of the wedge engagement corresponding to the external anchoring of the tension member in imposing the anchoring load on the tension member anchored to the underground anchor hole, and to an internal anchorage for more simply and efficiently removing the tension member using the wedge assembly without any removing equipment such as a drawbench.

BACKGROUND ART

As is well known to those skilled in the art, ground anchors are widely used as a sheet for preventing the collapse of non-excavated ground around a construction field in underground excavation for subsurface structure works to construct a building or engineering structures, and as a safety measure for preventing a landslide of a cross section of poor ground. These ground anchors are of various types, i.e., a compression type, a tension type, and a pressure type. The compression type ground anchor is usually used but cannot remove a tension member. The tension type ground anchor is restricted to point pressure, thereby having difficulty in removing a tension member after works. Considering anchoring force, in the tension type ground anchor, the anchoring force is reduced by tension cracking of a grouting member. The pressure type ground anchor is applied only to rock bed capable of point bearing.

The ground anchor inserts an internal anchorage into a perforated anchor hole in rock bed by using a tension member (PC strand wire) with excellent tension strength, and maintains tensile force by imposing tensile load on a free long side. Therefore, if the tension member remains on the underground after completing the construction work of the subsurface structure, this tension member may be an obstacle to other construction works of the subsurface structure on ground adjacent to this field. In a downtown area with many buildings, a tension member removing method has been used more and more. An anchorage used in this case is an internal anchorage for removing the tension member.

Korean Patent Publication No. 96-4273 discloses an internal anchorage for removing a tension member of a ground anchor. This internal anchorage includes a body provided a solar wedge seat and a planet wedge seat around the solar wedge seat, the solar wedge seat dividing a circumference into two or three equal parts of the planet wedge seat, a solar wedge and a planet wedge seated on a corresponding seat, spacers in the same number as the planet wedge, an upper cover for preventing the upper separation of the solar wedge and the planet wedge, and a cap coating on the body.

However, in addition to the tension member having tension force engaged with the planet wedge, the above-described conventional internal anchorage requires a retrieval tension member for removing this tension member, i.e., the tension member engaged with the solar wedge, and another wedge for engaging this tension member. Therefore, the above-described conventional internal anchorage includes many components, resulting in difficulty in manufacturing, and further additionally includes the retrieval tension member for removing the conventional tension member, thereby increasing production cost. Moreover, it is troublesome to operate the added tension member for removing the tension member.

Further, the spacer includes a taper on its inner surface. The taper of the spacer corresponds to the tapered retrieval tension member. The outer surface of the spacer must be a circular section corresponding to a hollow core of the body. That is, since the spacer is very complicated in shape and structure, it is difficult to manufacture and assemble the spacer. By forming a ring groove on the back surface of a hole of a central member perforated in an axial direction and fixing a C-type retaining ring into the groove, the central member cannot be removed from the back surface of the body during the period in which tension force does not work. Since this internal structure is also very complicated, it is difficult to manufacture.

Furthermore, when the engagement of the tension member becomes loose prior to removing the retrieval tension member, if an anchoring load is imposed on the tension member, the retrieval tension member may slip out of the solar wedge. In this case, the retrieval tension member, which should retrocede by the solar wedge, does not retrocede. Thereby, the planet wedges do not open and the tension member cannot be removed. That is, the tension member cannot be removed without a drawbench.

In order to overcome the drawbacks of the above-described internal anchorage for removing the tension member of the ground anchor, Korean Patent Laid-Open No. 2002-47445 is described hereinafter. An internal anchorage of this document has a structure such that a wedge support formed by covering an electric heater with a thermoplastic resin is inserted into a body provided with one wedge groove, or at least two wedge grooves, and a wedge box is mounted on the wedge support. A tip of the tension member is engaged between the body and the wedge seat of the wedge box, and is inserted into an underground anchor hole and anchored. Then, the tension member is drawn and its outer end is anchored to a furring strip of soil wall. If current flows from the exterior to the wire connected to the electric heater after the work, the electric heater emits heat and melts the wedge support made of resin. The molten wedge support slips out of a space perforated on the back surface of the body. At this time, the wedge remains in its original position but the wedge box is pulled into the outer end of the tension member by tension force of the tension member. As a result, the engagement of the wedge with the tip of the tension member is released, and the tension member may protrude as a result of the anchoring load imposed on it, and may be removed.

However, when this internal anchorage for removing the tension member is molten by the heating of the electric heater of the wedge support, a spark is generated by the contact of the exposed portion of the wire connected to the electric heater with the metal-made body. Therefore, it is very dangerous. Further, if a short circuit is generated during melting of the wedge support, the wedge support is no longer molten and the wedge box does not pull out. Thereby, the wedge engagement is not entirely released and the tension member is not retrieved. Furthermore, since the resin of the wedge support is a special resin, it has several drawbacks, such as a low molding tendency and high production cost.

DISCLOSURE OF THE INVENTION

Therefore, the present invention has been made in view of the above problems, and it is an object of the present invention to provide a wedge assembly for an internal anchorage for removing a tension member of a ground anchor, which removes a tension member by the release of the wedge engagement corresponding to the external anchoring of the tension member in imposing the anchoring load on the tension member anchored to the underground anchor hole.

In accordance with one aspect of the present invention, the above and other objects can be accomplished by the provision of an internal anchorage wedge assembly for removing a tension member of a ground anchor, the wedge assembly comprising spiral engagement teeth formed on an inner surface of the wedge, and an elastic ring inserted into the end of an outer surface in order to maintain an assembly condition of a circumference-dividing wedge. A front inner surface of the wedge is a smooth surface without engagement teeth, a traction jaw for mounting a wedge traction plate is formed on the end of the smooth surface in the circumferential direction, and an internal ring groove for a wedge expansion ring is formed on the back surface of the traction jaw.

In accordance with another aspect of the preset invention, there is provided an internal anchorage for removing a tension member of a ground anchor of the locking ring type. The internal anchorage comprises a wedge including an external ring groove formed on an end of an external surface, a traction jaw and an internal ring groove formed on the smooth front of the internal surface, engagement teeth formed on the back of the internal surface, a locking groove formed on the back of the external ring groove, a wedge traction platejaw engaged with the back of the traction jaw and pulling the wedge by the reaction force in releasing the external anchoring, when one terminal of the tension member toward the external anchoring is cut in order to remove an anchorage load, a wedge expansion ring inserted into the internal ring groove and expanding the wedge, a wedge box including a tension member hole formed on the back end, a tube seat for inserting and fixing a tube covering the tension member, the tube seat being formed around the tension member hole, a wedge seat for the wedge and a ring seat for a locking ring formed on the internal surface, a wedge separation layer interposed between the wedges, a cap covering the front end of the wedge box and protecting the components of the wedge box, and a wedge locking ring formed between the ring seat of the wedge box and the back end of the cap and locking the locking groove of the retroceding wedge.

In accordance with a further aspect of the present invention, there is provided an internal anchorage for removing a tension member of a ground anchor of the horn screw type. The internal anchorage comprises a wedge including an external ring groove formed on an end of an external surface, a traction jaw and an internal ring groove formed on the smooth front of the internal surface, engagement teeth formed on the back of the internal surface, a wedge traction plate having a horn screw formed on the center of the front surface, a jaw engaged with the back of the traction jaw and pulling the wedge by the reaction force in releasing the external anchoring, a wedge expansion ring inserted into the internal ring groove and expanding the wedge, a wedge box including a tension member hole formed on the back end, a tube seat for inserting and fixing a tube covering the tension member, the tube seat being formed around the tension member hole, a wedge seat for the wedge and a ring seat for a locking ring formed on the internal surface, a wedge separation layer interposed between the wedges, and a cap having a screw hole for engagement with the horn screw formed on the center of the back surface for covering the front end of the wedge box, and for protecting the components of the wedge box.

In accordance with yet another embodiment of the present invention, there is provided an internal anchorage for removing a tension member of a ground anchor of the elastic hook type. The internal anchorage comprises a wedge including an external ring groove formed on an end of an external surface, a traction jaw and an internal ring groove formed on the smooth front of the internal surface, engagement teeth formed on the back of the internal surface, a wedge expansion ring inserted into the internal ring groove and expanding the wedge, a wedge box including a tension member hole formed on the back end, a tube seat for inserting and fixing a tube covering the tension member, the tube seat being formed around the tension member hole, a wedge seat for the wedge and a ring seat for a locking ring formed on the internal surface, a wedge traction plate having an elastic hook formed on the center of the front surface, a jaw engaged with the back of the traction jaw and pulling the wedge by the reaction force in releasing the external anchoring, a wedge separation layer interposed between the wedges, and a cap having a hook hole and a hook engagement jaw for the elastic hook formed on the center of the back surface, for covering the front end of the wedge box, and for protecting the components of the wedge box. The hook of the wedge traction plate and a screw hole of the cap are used as retroceding wedge-locking means.

In accordance with still another embodiment of the present invention, there is provided an internal anchorage for removing a tension member of a ground anchor of the locking ring-safety ring type. The internal anchorage comprises a wedge including an external ring groove formed on an end of an external surface, a traction jaw and an internal ring groove formed on the smooth front of the internal surface, engagement teeth formed on the back of the internal surface, a locking groove formed on the back of the external ring groove, a ring horn for a wedge safety ring formed on the front end, a wedge expansion ring inserted into the internal ring groove and expanding the wedge, a wedge box including a tension member hole formed on the back end, a tube seat for inserting and fixing a tube covering the tension member, the, tube seat being formed around the tension member hole, a wedge seat for the wedge and a ring seat for a locking ring formed on the internal surface, a wedge traction platejaw engaged with the back of the tractionjaw and pulling the wedge by the reaction force in releasing the external anchoring, a cap covering the front end of the wedge box and protecting the components of the wedge box, an inner edge of the back end of the cap being an inclined surface, a wedge locking ring formed between the ring seat of the wedge box and the back end of the cap and locking the locking groove of the retroceding wedge, and a wedge separation layer interposed between the wedges; a wedge safety ring being inserted into the ring horn and stabilizing the wedge on the wedge seat, and a ring stand for supporting the wedge safety ring being disposed between the wedge locking ring and the back end of the cap.

In accordance with still yet another embodiment of the present invention, there is provided an internal anchorage for removing a tension member of a ground anchor of the horn screw-safety ring type. The internal anchorage comprises a wedge including an external ring groove formed on an end of an external surface, a traction jaw and an internal ring groove formed on the smooth front of the internal surface, engagement teeth formed on the back of the internal surface, a ring horn for a wedge safety ring formed on the front end, a wedge expansion ring inserted into the internal ring groove and expanding the wedge, a wedge box including a tension member hole formed on the back end, a tube seat for inserting and fixing a tube covering the tension member, the tube seat being formed around the tension member hole, a wedge seat for the wedge and a ring seat for a locking ring formed on the internal surface, a wedge traction plate having a horn screw formed on the center of the front surface, a jaw engaged with the back of the traction jaw and pulling the wedge by the reaction force in releasing the external anchoring, a cap having a screw hole for engagement with the horn screw formed on the center of the back surface and for covering the front end of the wedge box and protecting the components of the wedge box, an inner edge of the back end of the cap being an inclined surface, and a wedge safety ring inserted into the ring horn and supported between the ring seat of the wedge box and the inclined surface of the cap, thereby stabilizing the wedge.

BRIEF DESCRIPTION OF THE DRAWINGS

The above and other objects, features and advantages of the present invention will be more clearly understood from the following detailed description taken in conjunction with the accompanying drawings, in which.

BEST MODE FOR CARRYING OUT THE INVENTION

Figure 1:
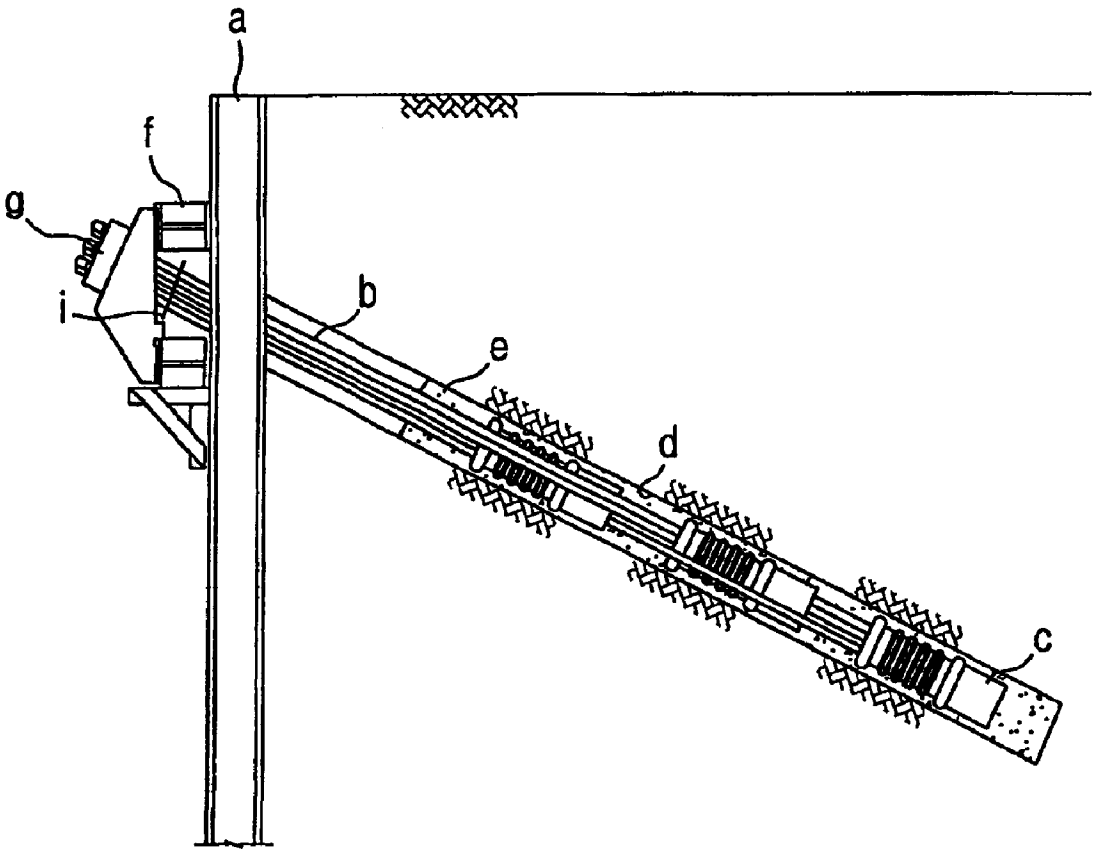
FIG. 1 is a schematic view of a conventional ground anchor.

FIG. 1, in a ground anchor for removing a tension member formed to fix a soil wall (a), an end of at least one strand of the tension member (b) is engaged with a wedge within an internal anchorage (c) and inserted into an anchor hole(d) drilled into the ground. An anchoring section of the anchor hole (d) is filled with a grout material (e), and anchored. Then, designated anchoring load is imposed on the tension member (b), the ground anchor being anchored to the furring strip(f) of the soil wall(a) by an external anchorage(g).

Figure 2:
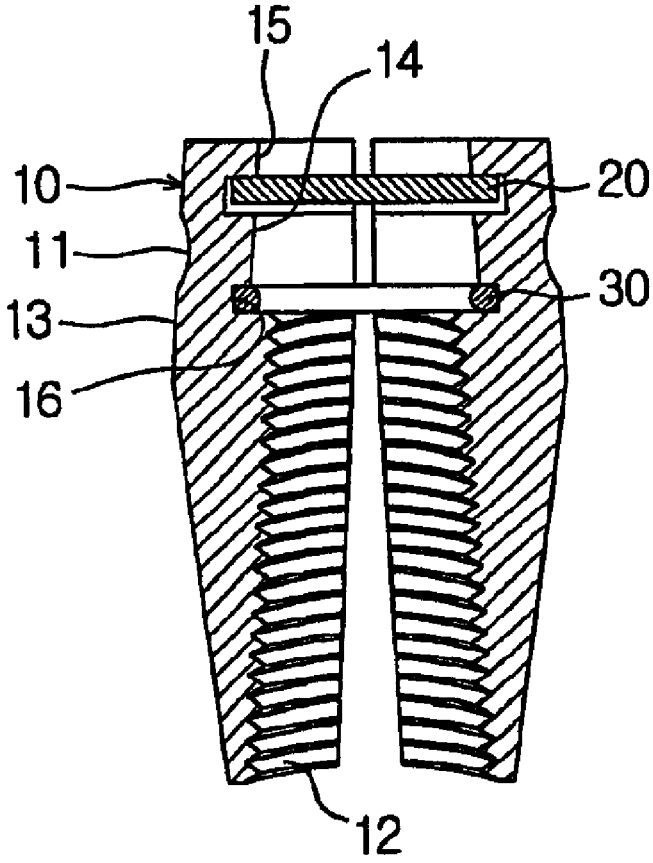
FIG. 2 is a cross-sectional view of a wedge complex for an internal anchorage for removing a tension member of the ground anchor in accordance with an embodiment of the present invention.

In FIG. 2, a wedge compound/complex, which is used in the internal anchorage for removing the tension member of the ground anchor, includes wedges 10 and a wedge traction plate 20. The circumference is divided into two or three equal parts by the wedges 10, and the wedges 10 are arranged along the circumference. The conventional wedge of the internal anchorage for removing the tension member of the ground anchor is tapered on its entire outer surface. An external ring groove 11 is formed on the end of the outer surface of the conventional wedge, and engagement teeth 12 are formed on the inner surface. The external ring groove 11 is a groove in which a rubber ring is inserted to maintain a combination of two or three wedges.

An external front part 13 of the wedge 10 of the present invention is straight. This part is required to obtain a minimal space for opening the wedges with an internal end of the wedge box, in order to easily untie the wedge engagement with the inner tip. Engagement teeth 12 are not formed on an inner front part 14 of the wedge 10. In addition, its radius is larger than that of the engagement teeth 12, thereby not engaging the end of the tension member with the wedge 10. This structure of the inner front part 14 is very important in easily untying the wedge engagement with the end of the tension member from the wedge 10 retroceded by the reaction force of the tension member by removing the external anchor of the tension member from the ground anchor installed on the ground anchor hole.

A traction jaw 15 is formed on the end of the inner front part 14 in a direction of the circumference. This traction jaw 15 determines the insertion length of the tension member when the tension member is engaged with the wedge 10 by inserting the end of the tension member into the wedge box. The traction jaw 15 is joined with the front edge of the wedge traction plate 20, which draws all of the wedges 10 of the internal anchorage by the reaction force of the tension member, if the tension member is extruded into the end of the internal anchorage by a reaction force corresponding to the anchoring load when the external anchoring of the tension member is untied in a situation wherein the anchoring load is imposed on the tension member of the internal anchorage anchored on the underground anchor hole. An inner ring groove 16 is formed on the back end of the inner front part 14 in a direction of the circumference. The inner ring groove 16 is a groove into which an expansion ring 30 for opening the wedges 10 in the centrifugal direction is inserted. The wedge 10 is applicable to a horn screw-type internal anchorage including a horn screw-integrated wedge traction plate as a locking means for fixing the preceding wedge, and a screw hole and a hook-type internal anchorage including a hook-integrated wedge traction plate and a hook clogging jaw.

The wedge traction plate 20 is a circular metal plate. The wedge traction plate 20 unties or releases the engagement of the wedge 10 with the tension member by drawing the wedge 10 through a force created when the tension member is extruded prior to the wedge box by a reaction force corresponding to the anchoring load at the moment when the external anchoring is untied at a condition of anchoring the internal anchorage on the underground anchor hole and imposing the anchoring load on the tension member. Until the internal anchorage is joined with the traction jaw 15 and transmits the reaction force of the tension member, untying the external anchoring, to the wedge 10 which is engaged with the end of the tension member and positioned within the wedge box, the wedge traction plate 20 is inserted and anchored into the underground anchor hole, and the tension member is removed. Therefore, the wedge traction plate 20 must have a sufficient strength to avoid deformation in response to the reaction force corresponding to the anchoring load, and must have a sufficient radius not to be extruded into the traction jaw 15.

Figure 3:
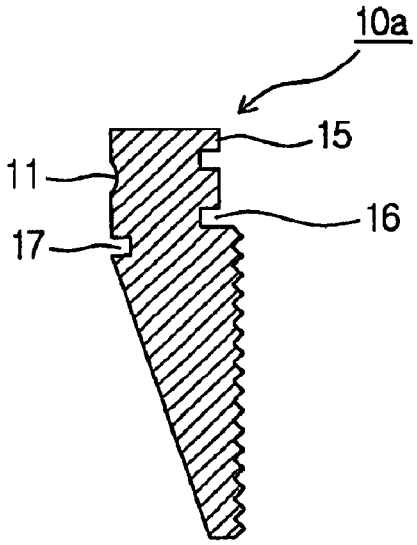
FIG. 3 is a perspective view of a wedge in accordance with a further embodiment of the present invention.

In FIG. 3, a wedge 10*a* of another embodiment of the present invention is applicable to a locking ring-type internal anchorage, which locks the preceding wedge with a locking ring. Compared to the above-described basic wedge 10, the wedge 10*a* additionally includes a locking groove 17 on the back of the external ring groove 11. The locking groove 17 easily removes the tension member, untying or releasing the wedge engagement, by locking the preceding wedge 10*a* with the locking ring positioned between the ring seat of the wedge box and the back surface of the cap, when the wedge 10*a* is preceded by the force of extruding the tension member into the end of the wedge box by the reaction force at the moment of removing the external anchoring from the tension member imposing the anchoring load thereon. In this case, the external ring groove 11 is thin and its edges are slowly curved. This structure, in which the locking ring is engaged with the external ring groove 11 instead of the rubber ring, maintains the combinations of the wedge at the normal condition. Further, when the tension member is moved into the tensile direction by the anchoring load, or when the wedge is preceded by the reaction of the tension member by removing the external anchoring of the tension member, this structure makes the wedge 10*a* precede or retrocede by extruding the external ring groove 11 from the locking ring.

Figure 4:
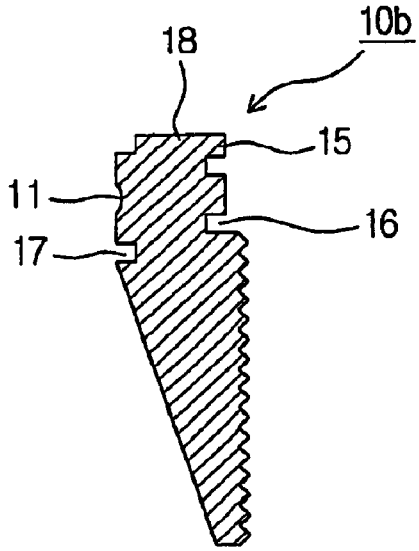
FIG. 4 is a perspective view of a wedge in accordance with another embodiment of the present invention.

With reference to FIG. 4, a wedge 10*b* of yet another embodiment of the present invention is applicable to the locking-ring type internal anchorage for locking the retroceding wedge, the horn screw type internal anchorage, and the hook type internal anchorage. The wedge 10*b* additionally includes a ring horn 18 for inserting a wedge safety ring into the end of the basic wedge to or the locking ring type wedge 10 The ring horn 18 serves to receive a C-type safety ring formed between the ring seat of the wedge box and the back end of the cap in order to treat and carry the internal anchorage engaged with the wedge. This is accomplished by inserting the end of the tension member into the tension member hole of the wedge box and covering with the cap, and maintaining the wedge engagement with the end of the tension member until the internal anchorage is inserted into the anchor hole and anchored thereto.

Figure 5:
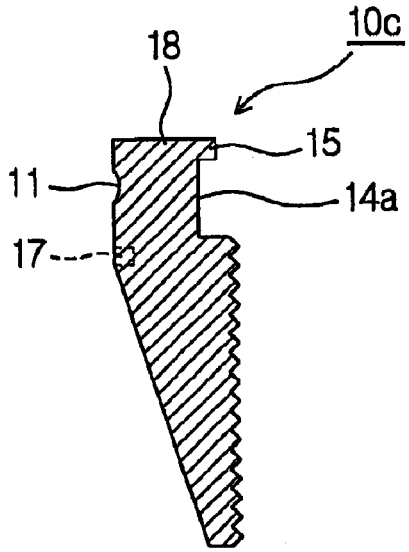
FIG. 5 is a perspective view of a wedge in accordance with yet another embodiment of the present invention.

With reference to FIG. 5, a wedge 10*c* of yet still another embodiment of the present invention has an inner front part 14*a* with the same radius as that of a slot of the traction jaw 15. The wedge 10*c* is applicable to internal engagement with a horn screw integrated with its front surface in accordance with other embodiments of the present invention. A tension member cap covering the end of the tension member formed on the back surface.

Figure 6:
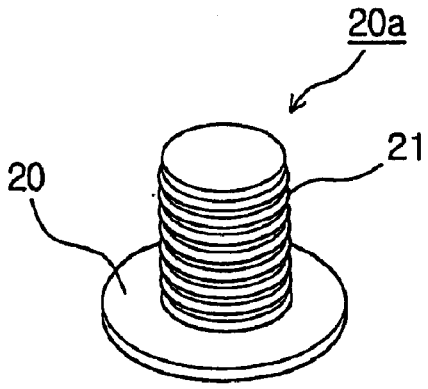
FIG. 6 is a perspective view of a horn screw type wedge traction plate.

With reference to FIG. 6, a wedge traction plate 20*a* of the yet another embodiment of the present invention includes a horn screw 21 which engages a screw hole of the cap with the front surface of the basic wedge traction plate 20. If the wedge engagement with the end of the tension member is not perfectly released, even by turning the outer end of the tension member in a reverse direction of the engagement teeth of the wedge 10 or 10*c*, and by deviating the outer end of the tension member from the wedge 10 or 10*c* after releasing the external anchoring of the tension member, the wedge traction plate 20*a* is a wedge pulling element which forces the wedge traction plate 20*a* to pull all the wedges 10 or 10*c* by turning the wedge traction plate 20*a* and by engaging the wedge traction plate 20*a* with the screw hole of the cap. Further, the wedge traction plate 20*a* is a locking element for gripping the wedge 10 while perfectly releasing the wedge engagement from the end of the tension member and drawing and removing the tension member.

Figure 7:
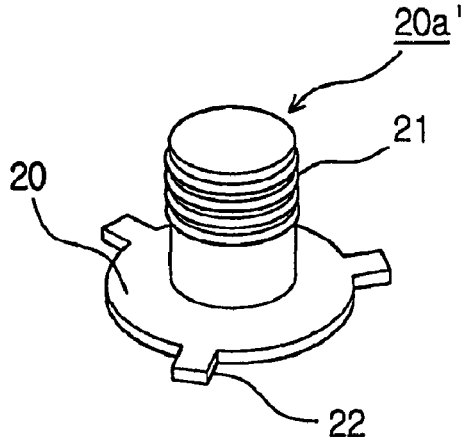
FIG. 7 is a perspective view of a modified horn screw type wedge traction plate.
Figure 8:
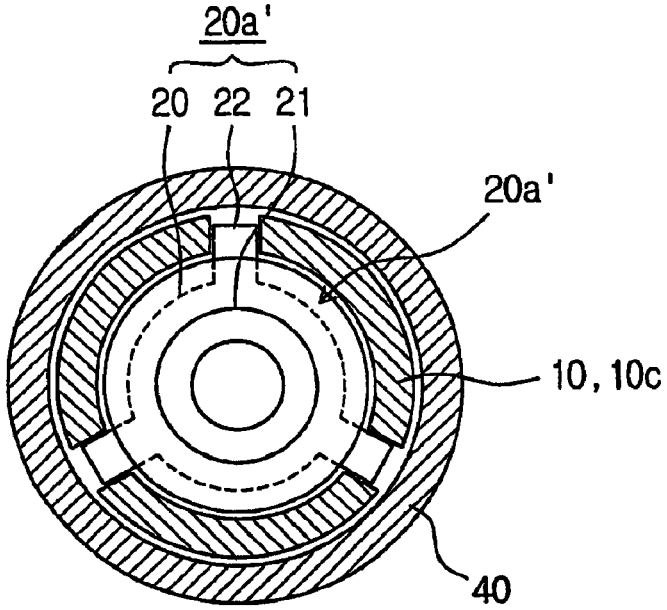
FIG. 8 is a cross-sectional plan view of the modified horn screw type wedge traction plate drawn into a traction jaw of a wedge.

With reference to FIG. 7, a wedge traction plate 20*a'* of the yet still another embodiment of the present invention includes at least one side horn 22 disposed on its circumference. As shown in FIG. 8, the side horn 22 serves to engage the horn screw 21 of the wedge traction plate 20*a'* with the screw hole of the cap by transmitting, into the wedge 10 or 10*c*, the force for retaining the external anchoring-removed tension member b by being inserted into a side gap of the wedge 10 or 10*c*, when the wedges 10 or 10*c* are engaged in the circumference direction.

Figure 9:
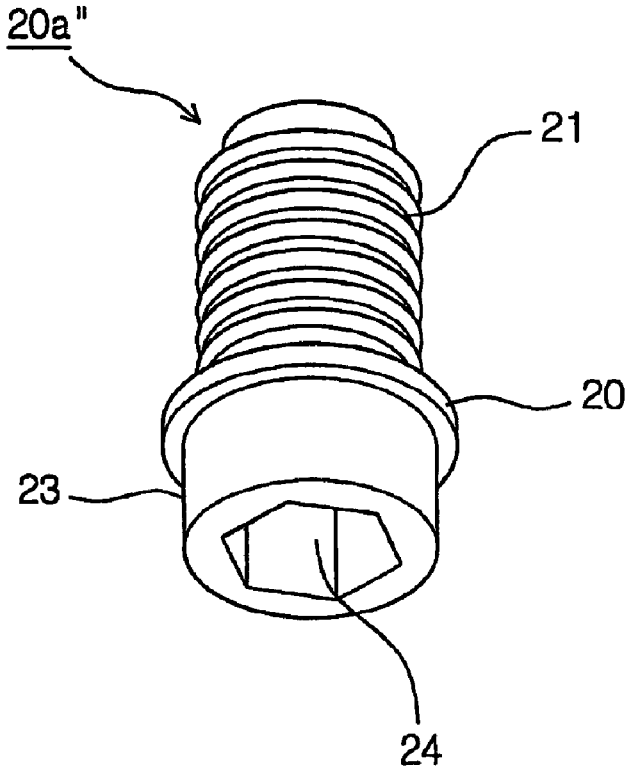
FIG. 9 is a perspective view of another modified horn screw type wedge traction plate.

FIG. 9 shows a modification of the horn screw wedge traction plate 20*a*'. The cross-section of the tension member and a tension member cap 23 are integrally formed in the same direction as the axial direction of the horn screw 21. The front end of the tension member is exactly engaged with the tension member groove 24. Therefore, the force of turning the external anchoring-removed tension member in one direction is transmitted to the wedge traction plate 20*a''* through the tension member cap 23, thereby engaging the horn screw 21 with the screw hole of the cap 23.

Figure 10:
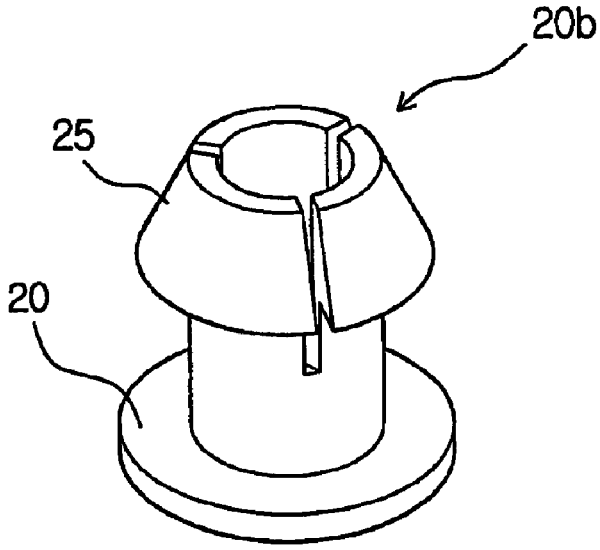
FIG. 10 is a perspective view of a hook type wedge traction plate.

FIG. 10 shows a wedge traction plate 20*b* with an elastic hook 25 instead of the horn screw 21 of the wedge traction plate 20*a*. The wedge traction plate 20*b* is applicable to an internal anchorage with a hook hole for joining the elastic hook 25 on the seat of a screw hole of the cap and a wedge locking means preceding the cap with a hook engagement jaw. The elastic hook 25 is a wedge locking element. That is, when external anchoring with the back end of the tension member is removed, the tension member is protruded into its end by the reaction force of the anchoring load. At this time, the elastic hook 25 proceeds together with the wedge traction plate 20b pulling all the wedges 10. When the elastic hook 25 enters the hook hole of the cap, the elastic hook 25 elastically constricts and, when the elastic hook 25 passes through the hook hole of the cap, the elastic hook 25 elastically expands. Thereby, the elastic hook 24 prevents the engagement-released wedges 10 from being pulled by the tension member.

Hereinafter, according to the aforementioned wedges 10, 10*a* to 10*c* and the wedge traction plates 20, 20*a* to 20*b*, the internal anchorages for removing the tension member of the ground anchor are described in detail. The internal anchorages provided by the present invention are mainly divided into three types, i.e., locking ring type, horn screw type, and hook type. These types of internal anchorages are differentiated by the locking element used to prevent the wedge from coming out together with the drawn and removed tension member after the wedge engagement with the end of the tension member is untied or released.

The internal anchorages according to types of the wedge locking element, the applicable wedges, and the wedge traction plates are described as follows.

Locking Ring Type Internal Anchorage c1

Figure 11:
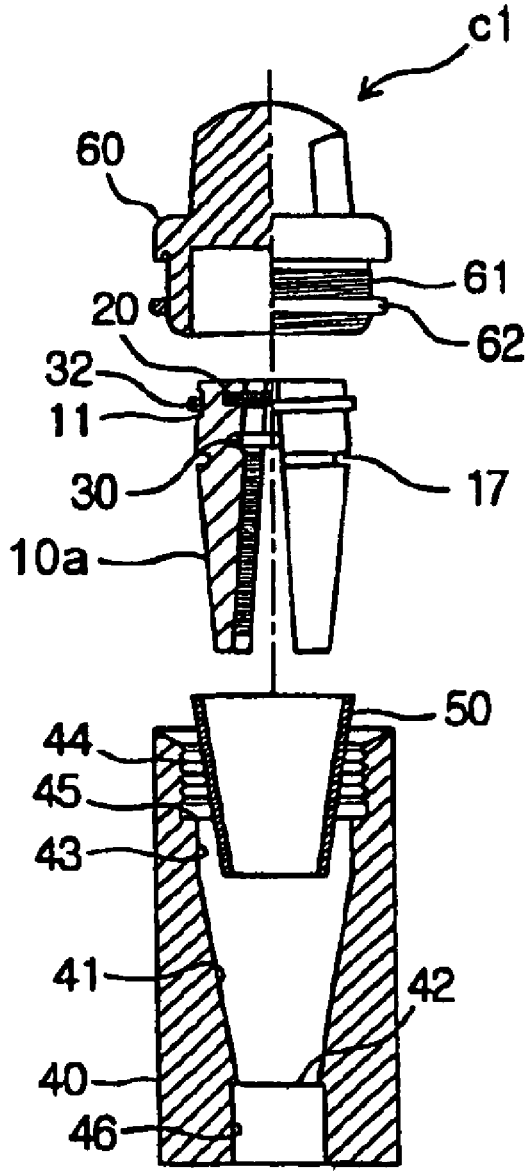
FIG. 11 is an exploded view of a locking ring-type internal anchorage.

As shown in FIG. 11, the locking ring type internal anchorage c1 includes the wedges 10*a* with the locking groove 17 added to the basic wedge, the basic wedge traction plate 20, the wedge expansion ring 30, the wedge locking ring 32, the wedge box 40, the wedge separation layer 50 and the cap 60. The wedge expansion ring 30 serves to expand the plural wedges 10*a*, arranged in the circumferential direction, in the centrifugal direction by being inserted into the internal ring groove 16 of the wedge 10*a*. The wedge expansion ring 32 is a C-type elastic ring with an excellent elasticity. The wedge locking ring 32 is inserted into the external ring groove 11 of the wedge 10*a* arranged in the circumferential direction, then seated on the ring seat 45 of the wedge box 40 while maintaining this arrangement, and retained by the back end of the cap 60 on the wedge box 40. Thereby, the wedge-locking ring 32 remains until the release of the external anchoring of the tension member, and when the locking groove 17 of the wedge 10*a* coincides with the wedge-locking ring 32, the wedge-locking ring 32 locks the locking groove 17 of the wedge 10*a*. Herein, the locking groove 17 and the wedge-locking ring 32 are wedge-locking elements.

The wedge box 40 includes reversed conical wedge seats 41, a tension member hole 42 formed on the back end of the wedge seats 41, and tube seats 46 disposed around the tension member 42. Spacers 43 for obtaining space for expanding the wedge 10*a* in the centrifugal direction are formed on the front of the wedge seat 41. Screws 44 for engaging the cap 60, and ring seats 45 for the wedge-locking ring, are formed on the front end of the spacer 43.

The wedge separation layer 50 is interposed between the wedge seat 41 and the wedge 10*a* in order to easily separate the wedge 10*a* from the wedge seat 41 of the wedge box 40, when the wedge 10*a* is withdrawn by the reaction force of the external anchoring-removed tension member, and the wedge engagement with the tension member is untied or released. Therefore, the wedge separation layer 50 serves to prevent the attachment of the wedge 10*a* to the wedge seat 41 and uses a non-adhesive resin film, an asbestos, or glass fiber. The cap 60 is formed on the end of the wedge box 40 and protects the components of the wedge box 40. The cap 60 includes screw 61 corresponding to the screws 44 of the wedge box 40. Reference number 62 identifies a ring packing.

Figure 12:
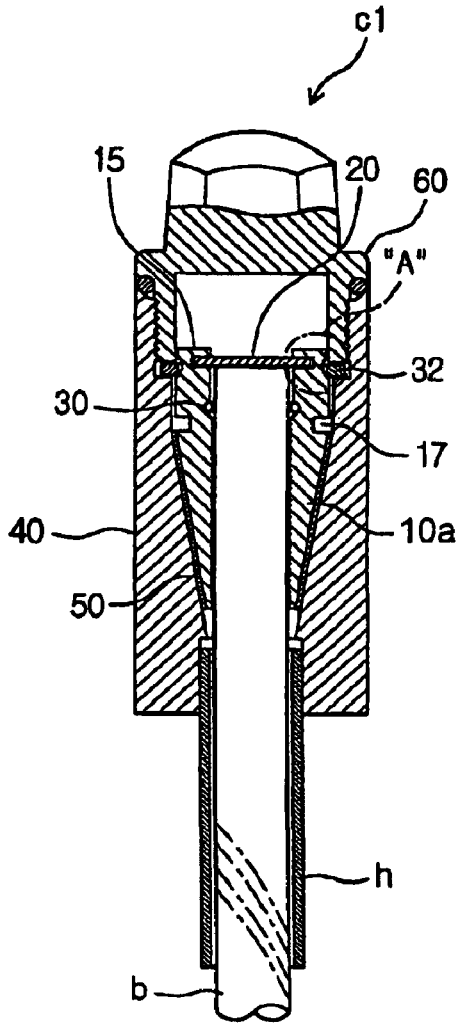
FIG. 12 is an assembled cross-sectional view of the locking ring-type internal anchorage.

As shown in FIG. 12, the wedge traction plate 20 and the wedge expansion ring 30 are arranged in parallel with each other. The traction jaw 15 of each wedge 10*a* is rested on the front edge of the wedge traction plate 20 and the internal ring groove 16 of the wedge 10*a* is engaged with the wedge expansion ring 30. The wedge-locking ring 32 is inserted into the external ring groove 11, thereby maintaining the assembly of the wedge 10*a*. Then, the tube-coated end of the tension member b is inserted into the wedge box 40 via the tension member hole 32. The back end of the wedge 10*a* is expanded in the centrifugal direction and is inserted into the front end of the tension member until the front end of the tension member reaches the wedge traction plate 20. The wedge separation layer 50 is attached to the wedge seat 41 of the wedge box 40. The wedge separation layer 50 may be attached to the circumference of the wedge 10*a* and has the same size as, or a smaller size than, the circumferential surface of the wedge 10*a*. The wedge 10*a*, engaged with the end of the tension member b, is inserted from the end of the wedge box 30. The wedge-locking ring 32 is seated on the ring seat 45 and the cap 60 is installed on the end of the wedge box 30. Then, the wedge 10*a* is hermetically sealed with a sealant. At this time, the cap 60 softly presses the wedge-locking ring 32 and is elastically constricted in contacting the locking groove 17. The tube h is inserted so that its end contacts the tube seat 46 and it is hermetically sealed with a sealant in order to prevent it from being exposed to moisture. Thereby, the assembly of the locking ring type internal anchorage cl, the tension member b and the tube h is completed.

Figure 13:
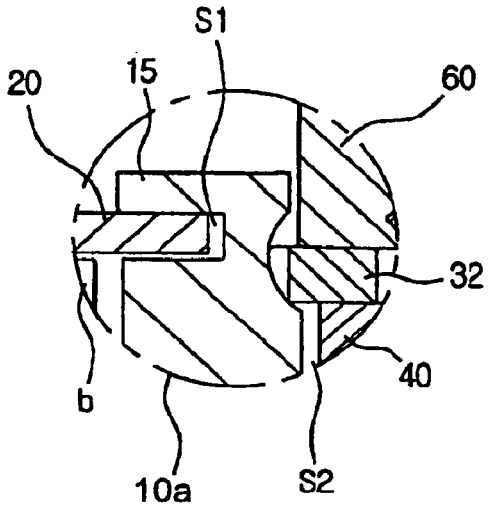
FIG. 13 is an enlarged view of a part "A" of FIG. 11.

As shown in FIG. 13, the assembled locking ring type internal anchorage c1 includes a space S1 formed between the back side of the traction jaw 15 and the circumference of the traction plate 20, and a space S2 formed between the spacers 43 of the wedge box 40 and the front outer surface of the wedge 10*a*. Thereby, the front end of the wedge 10*a* can be contracted in the centrifugal direction. The back end of the wedge 10*a* is expanded in the centripetal direction.

Figure 14:
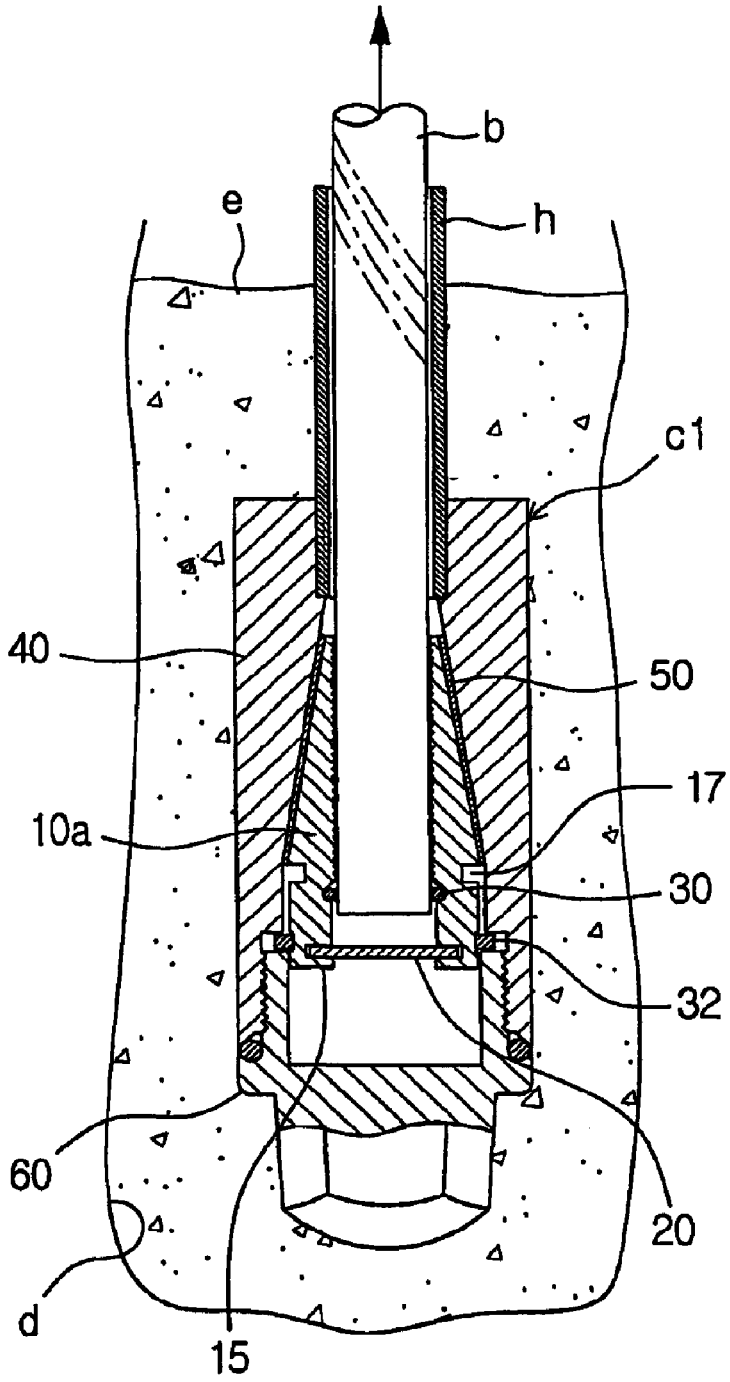
FIG. 14 is a cross-sectional view showing a condition of anchoring the internal anchorage to an underground anchor hole and imposing an anchorage load on the tension member.

As shown in FIG. 14, the internal anchorage c1 engaged with the end of the tension member b is inserted into the underground anchor hole d and its anchoring section is filled with the grout material e. Then, the anchoring load is imposed on the tension member b and the internal anchorage c1 is anchored to a furring strip by the external anchorage. A strand wire used as the tension member of the ground anchor has a tension load limit of a little more than approximately 15 ton. However, the design anchoring load of the strand wire used as the tension member of the ground anchor is about 11 to 12 ton. At the early stage of the assembly of the internal anchorage c1, the wedge engagement is somewhat loose. However, when the tension force is imposed on the tension member b, as the wedge 10*a* is drawn by the tension member b, the wedge engagement with the tension member b becomes tight by the interaction with the wedge seat 41. When the a predetermined time has passed, the wedge 10*a* within the wedge box 40 does not move any more.

Figure 15:
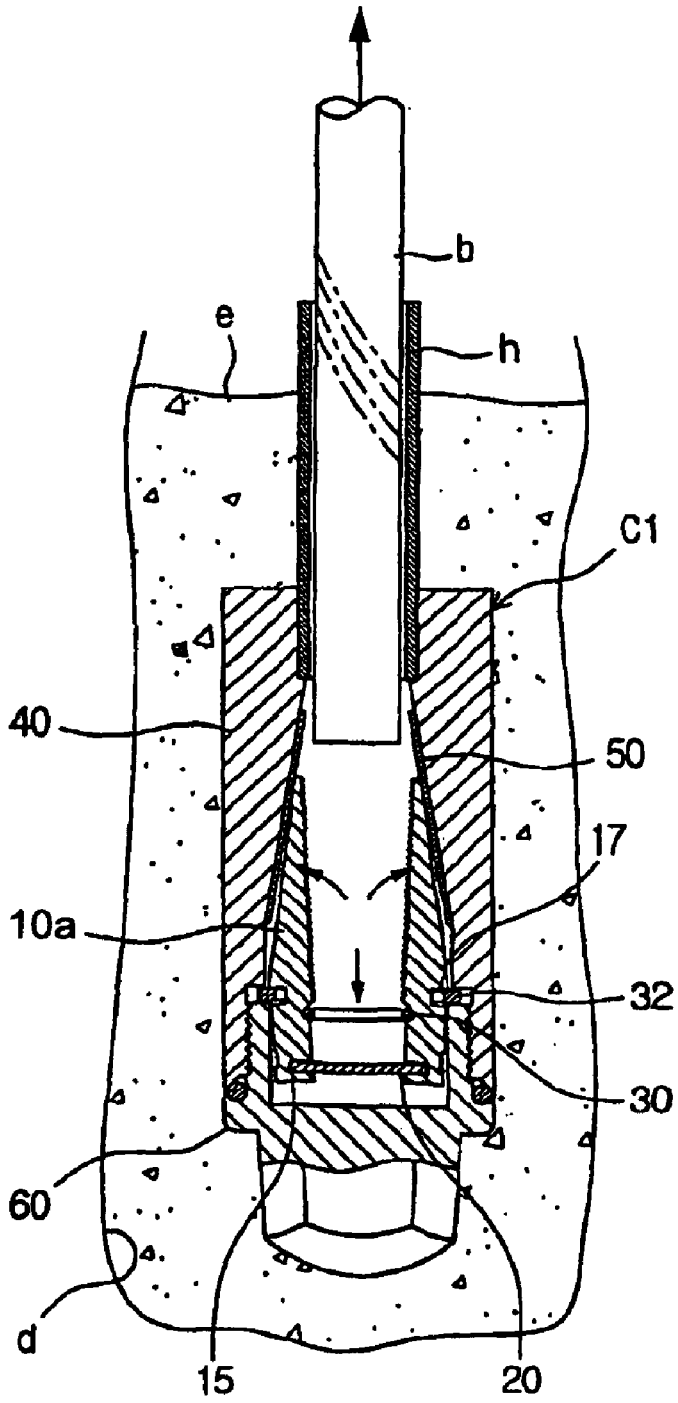
FIG. 15 is a cross-sectional view showing a condition of untying a wedge engagement by removal of an external anchoring of the tension member.

As shown in FIG. 15, the external anchoring of the tension member b is removed after finishing subsurface construction work. Removal of the external anchoring of the tension member b is divided into two methods. One method involves of removing the external anchorage g in FIG. 1. The other method involves cutting a part i of the tension member just inside of the external anchorage g. In either method, at the moment of removing the external anchorage of the tension member b, a reaction force corresponding to the anchoring load is imposed on the tension member b. By virtue of this reaction force, the tension member b is extruded into the end. The extruded tension member b pushes the wedge traction plate 20. Then, the wedge traction plate 20 pulls all the wedges 10*a* and the traction jaw 15 at the same time. Thereby, the wedges 10*a* retrocede. However, the wedge locking ring 32 is blocked by the back end of the cap 60 and is retained. At the same time, the external ring groove 11 is removed from the wedge locking ring 32.

As the wedges 10*a* retrocede, the locking groove 17 is coincident with the inner surface of the wedge locking ring 32. Then, the wedge locking ring 32 elastically protrudes between the ring seat 45 and the back end of the cap 60, and is engaged with the locking groove 17. Thereby, the wedge 10*a* cannot move. During retroceding of the wedge 10*a*, the wedge expansion ring 30 is elastically expanded to open all the wedges 10*a* in the centrifugal direction. The aforementioned motions of the tension member b, the wedge 10*a*, the wedge traction plate 20, and the wedge expansion ring 30 stop, together with the locking of the locking groove 17 by the wedge locking ring 32. In this case, the wedge 10*a* is entirely opened. Therefore, the end of the tension member b, which was engaged with the wedge 10*a*, is released.

In order to prevent corrosion of the tension member b within the underground anchor hole and to easily remove the tension member b, the tension member b is coated with a lubricant and covered with the tube h. Herein, the tube h is fixed by the grout material e of the underground anchor hole. Therefore, even when the tension member b is drawn and removed, the tube h is maintained within the anchor hole d. Thereby, when the wedge engagement of the wedge 10*a* with the end of the tension member b is drawn and removed, the tension member b can be easily removed by human power.

Horn Screw Type Internal Anchorage c2

Figure 16:
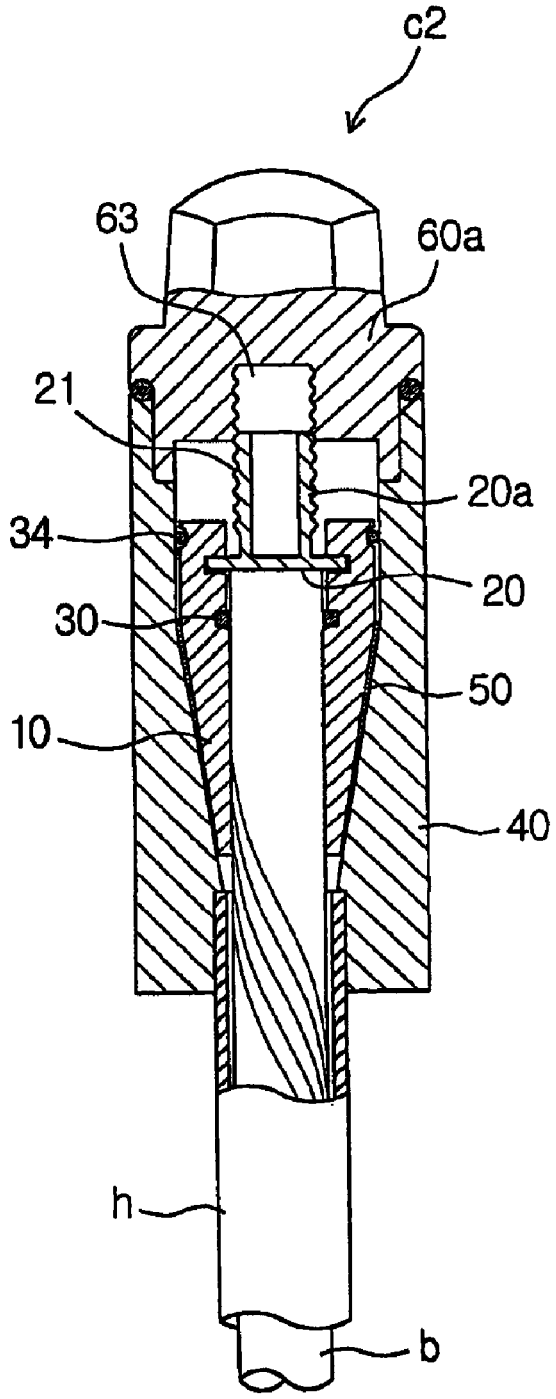
FIG. 16 is a cross-sectional view of an internal anchorage employing a horn screw-integrated wedge traction plate.

With reference to FIG. 16, the horn screw type internal anchorage c2 uses a horn screw-integrated wedge traction plate 20*a* and a cap 60*a* provided with a horn screw hole 63 as a retroceded wedge locking means. In this case, the locking groove 17 and the wedge locking ring 32 are unnecessary. The wedges with a traction jaw 15 are applicable. Herein, the basic wedge 10 is employed. The wedge expansion ring 30, the wedge box 40, and the wedge separation layer 50 are the same as those of the aforementioned locking ring type internal anchorage c1. Instead of the wedge locking ring 32 of the aforementioned locking ring type internal anchorage c1, a rubber elastic ring 34 is used. The end of the screw hole 63 of the cap 60*a* is not perforated and is thus extremely watertight within the underground anchor hole.

The wedge 10, the wedge traction plate 20*a*, and the wedge expansion ring 30 are assembled in the same manner as the aforementioned locking ring type internal anchorage c1, so that the horn screw 21 is exposed to the end of the wedge box 40. Then, the assembly is maintained by inserting the rubber elastic ring 34 into the external ring groove 11. The end of the tube h-covered tension member b is inserted into the tension member hole 42 of the wedge box 40 and is engaged with the wedge 10 until this end contacts the back surface of the wedge traction plate 20*a*. The wedge separation layer 50 is formed on the wedge seat 41 of the wedge box 40, and the wedge 10 engaged with the end of the tension member b is installed on the wedge box 40. Then, the cap 60*a* is installed on the end of the wedge box 40.

At this time, the edge of the screw hole 63 of the cap 60*a* presses on the end of the horn screw 21. Thereby, the back edge of the wedge traction plate 20*a* contacts the back jaw 15*a* of the traction jaw 15, and presses and fixes the wedge 10. Then, the wedge 10 engaged with the end ofthe tension member b is fixed, and the wedge engagement is not loosened even by the impact and vibration imposed on the wedge 10 and the wedge box 40, and the shaking of the tension member b, during treating. The tube h is inserted so that its end contacts the tube seat 46, and it is hermetically sealed with sealant to prevent exposure to humidity. Thereby, the assembly of the internal anchorage c2, the tension member b and the tube h is completed.

Figure 17:
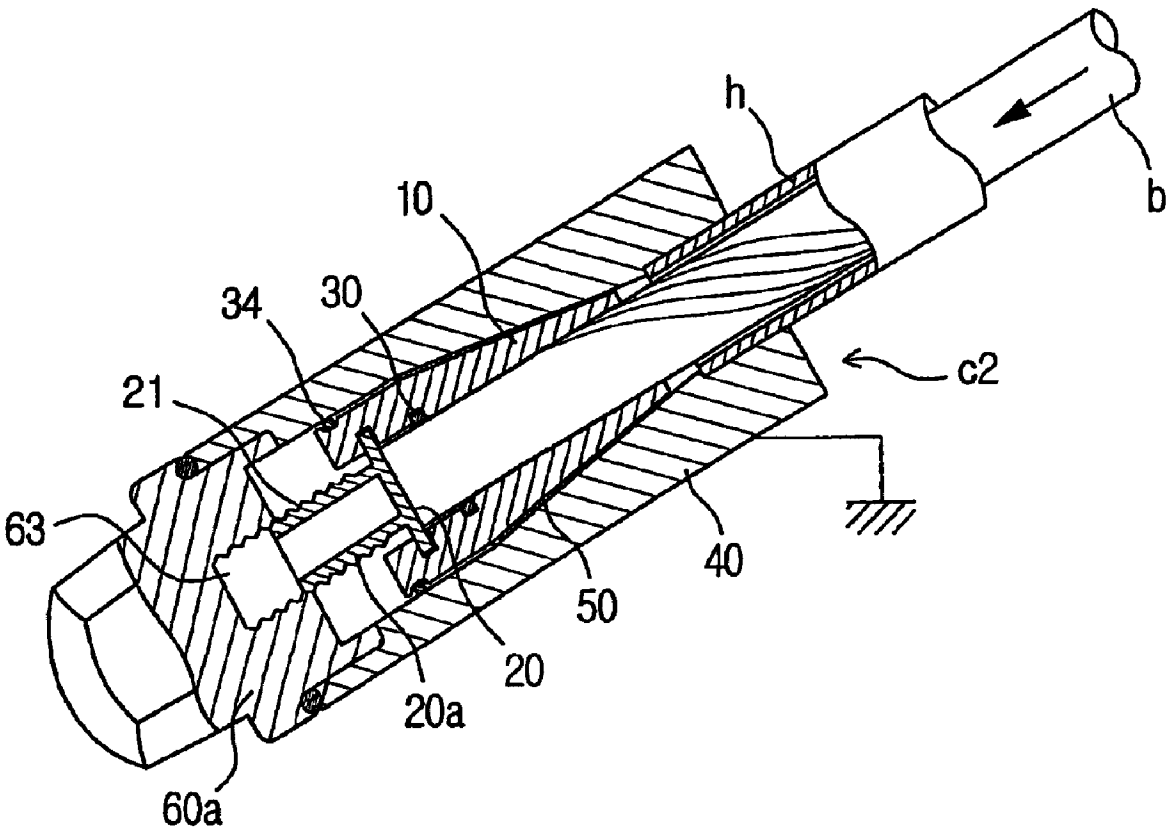
FIG. 17 is a cross-sectional view showing a condition of anchoring the internal anchorage to an underground anchor hole and imposing an anchorage load on the tension member.

As shown in FIG. 17, the internal anchorage c2 engaged with the end of the tension member b is inserted into the anchor hole in the underground and the anchoring section is filled with the grout material. The internal anchorage c2 is anchored by imposing the anchoring load on the tension member b. Even if the wedge engagement with the end of the tension member b is loose at the early stage of assembly, the wedge 10 is pulled by the tension member b by imposing a large anchoring load on the tension member b. In the process, the wedge 10 is strongly engaged with the end of the tension member b by the interaction of the wedge seat 41. Herein, the wedge traction plate 20*a* is pulled by the wedge 10. After a predetermined time, the wedge 10 does not move any more within the wedge box 30. The wedge traction plate 20*a* is the same as that of wedge 10*a* previously discussed. From this, the anchoring load starts to be imposed on the tension member b, and the final anchoring load is maintained until the external anchoring to the tension member b is removed.

Figure 18:
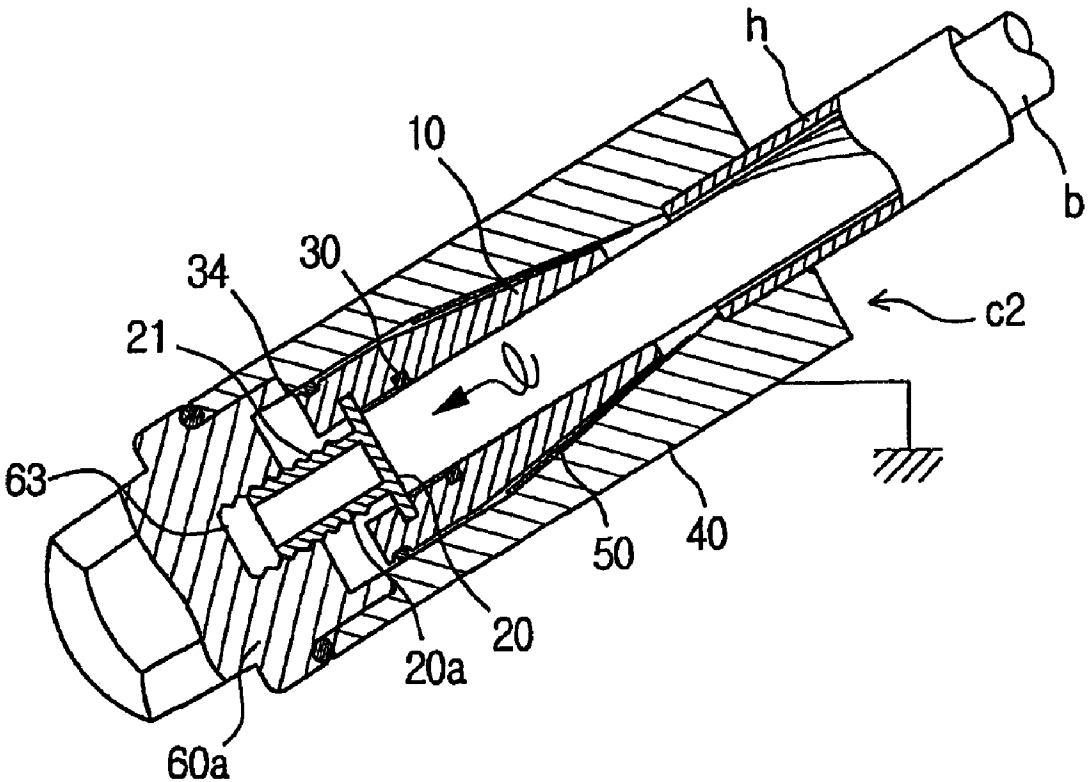
FIG. 18 is a cross-sectional view showing a condition of untying a wedge engagement by removal of an external anchoring of the tension member.

As shown in FIG. 18, at the moment of removing the external anchoring from the tension member b, the tension member b is extruded into/toward the end by a reaction force corresponding to the anchoring load. The external tension member b pushes the wedge traction plate 20*a*. The wedge 10 pulls the traction jaw 15 of all of the wedges 10. This movement is not stopped until the end of the horn screw 21 contacts the edge of the screw hole 63. That is, it is returned to the original position in which the anchoring load is imposed on the tension member b. Then, the external terminal of the tension member b is turned in the screw direction of the horn screw 21. Thereby, the horn screw 21 is joined with the screw hole 63 of the cap 60. As the horn screw 21 is joined with the screw hole 63, the wedge traction plate 20*a* pulls all of the wedges 10 at a time. As the wedges 10 are pulled by the wedge traction plate 20*a*, the wedges 10 are expanded in the centrifugal direction. Simultaneously, the tension member b is pulled away from the engagement teeth 12. Thus, the end of the tension member is finally deviated from the wedge 10. That is, the wedge engagement with the end of the tension member b is released.

If the wedge engagement-released tension member b is pulled, the tension member b comes out. However, the wedges 10 and the wedge traction plate 20*a* are pulled by the tension member b. Since the wedge engagement with the end of the tension member b is entirely released, the horn screw 21 joined with the screw hole 63 locks the wedge traction plate 20*a*, and the traction jaw 15 of the wedge 10 is engaged with the edge of the wedge traction plate 20*a*. Even if the tension member b is drawn, the wedges 10 are not pulled by the tension member b.

Horn Screw Type Internal Anchorage c2'

Figure 19:
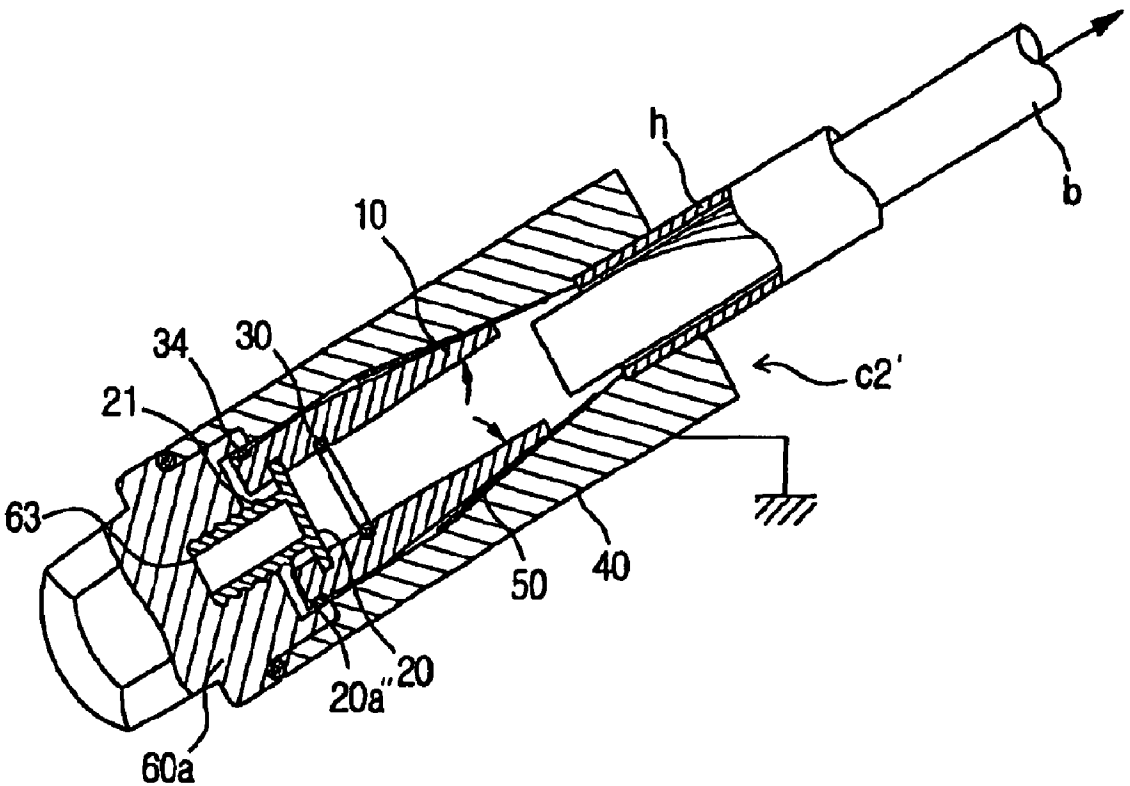
FIG. 19 is a cross-sectional view of an internal anchorage employing a horn screw-integrated wedge traction plate with a tension member cap.

As shown in FIG. 19, in another embodiment, the wedges 10 and the horn screw type wedge traction plate 20*a* of the horn screw type internal anchorage c2 previously discussed are replaced by the horn screw 21-tension member cap 23 type wedge traction plate 20*a*″ of FIG. 9. When the horn screw 21 is joined with the screw hole 63 by turning the external anchoring-released tension member b, this turning force is transmitted to the wedge traction plate 20*a*". Therefore, the tension member b is more easily removable.

Hook Type Internal Anchorage c3

Figure 20:
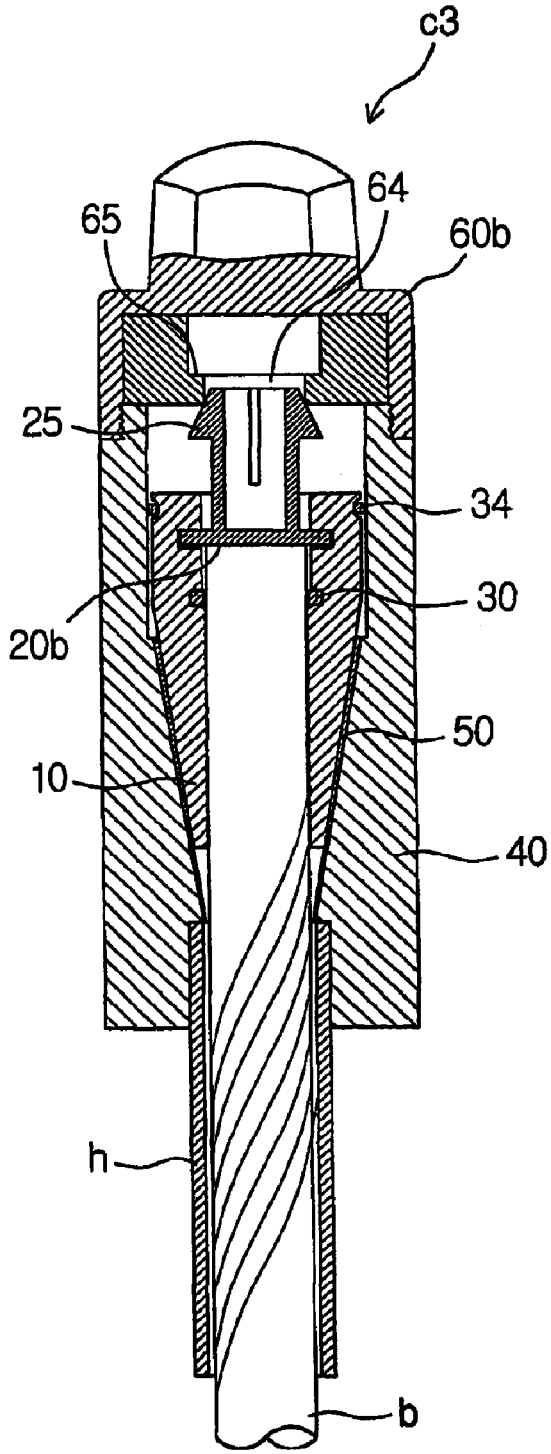
FIG. 20 is an assembled cross-sectional view of an internal anchorage employing a hook-integrated wedge traction plate.

As shown in FIG. 20, a hook type internal anchorage c3 includes the wedges 10, the wedge traction plate 20*b* with the elastic hook 25, and the cap 60*b* with the hook hole 64 and the hook engagement jaw 65. The cap 60*b* serves as a locking element for the retrocede wedges. Other components and the order of assembly of the hook type internal anchorage c3 are the same as those of the horn screw type internal anchorages c2, c2'.

When the wedges 10, engaged with the end of the tension member b, and the cap 60*b* are joined, the elastic hook 25 softly contacts the edge of the hook hole 64, and the lock edge of the wedge traction plate 20*b* presses the back jaw 15a of the wedge, thereby preventing the loosening of the wedge engagement at the end of the tension member b.

Figure 21:
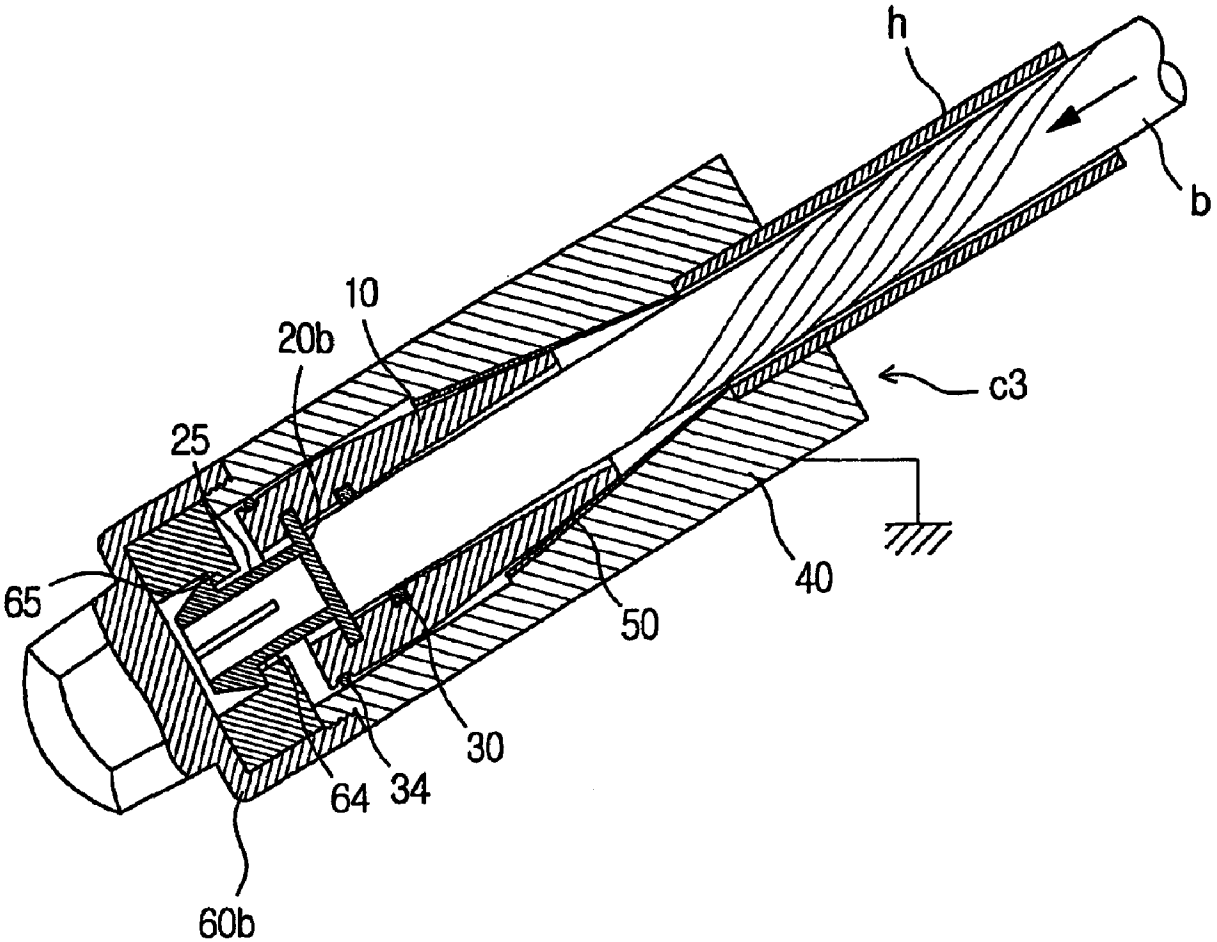
FIG. 21 is a cross-sectional view showing a condition of anchoring the internal anchorage to an underground anchor hole and imposing an anchorage load on the tension member.

As shown in FIG. 21, the internal anchorage c3 engaged with the end of the tension member b is inserted into the underground anchor hole d (FIG. 1), the anchoring section being filled with the grout material e. Then, the anchoring load is imposed on the tension member b. At the early stage of the assembly, the wedge engagement to the end of the tension member b is loose. However, since the end of the tension member b is engaged with the engagement teeth 12 (FIG. 2), the wedges 10 are pulled by the tension member b from the point in time when the anchoring load is imposed on the tension member b. At this time, the wedges 10 are more tightly engaged with the end of the tension member b by virtue of the interaction with the wedge seats 41. Also, the wedge traction plate 20*b* is pulled by the wedges 10. When the wedges 10 reach the designated time, the wedges 10 are no longer pulled by the tension member b. The same is true of wedge traction plate 20*b*. Then, the anchoring load is substantially imposed on the tension member b, the anchoring load being maintained until the external anchoring is released from the tension member b.

Figure 22:
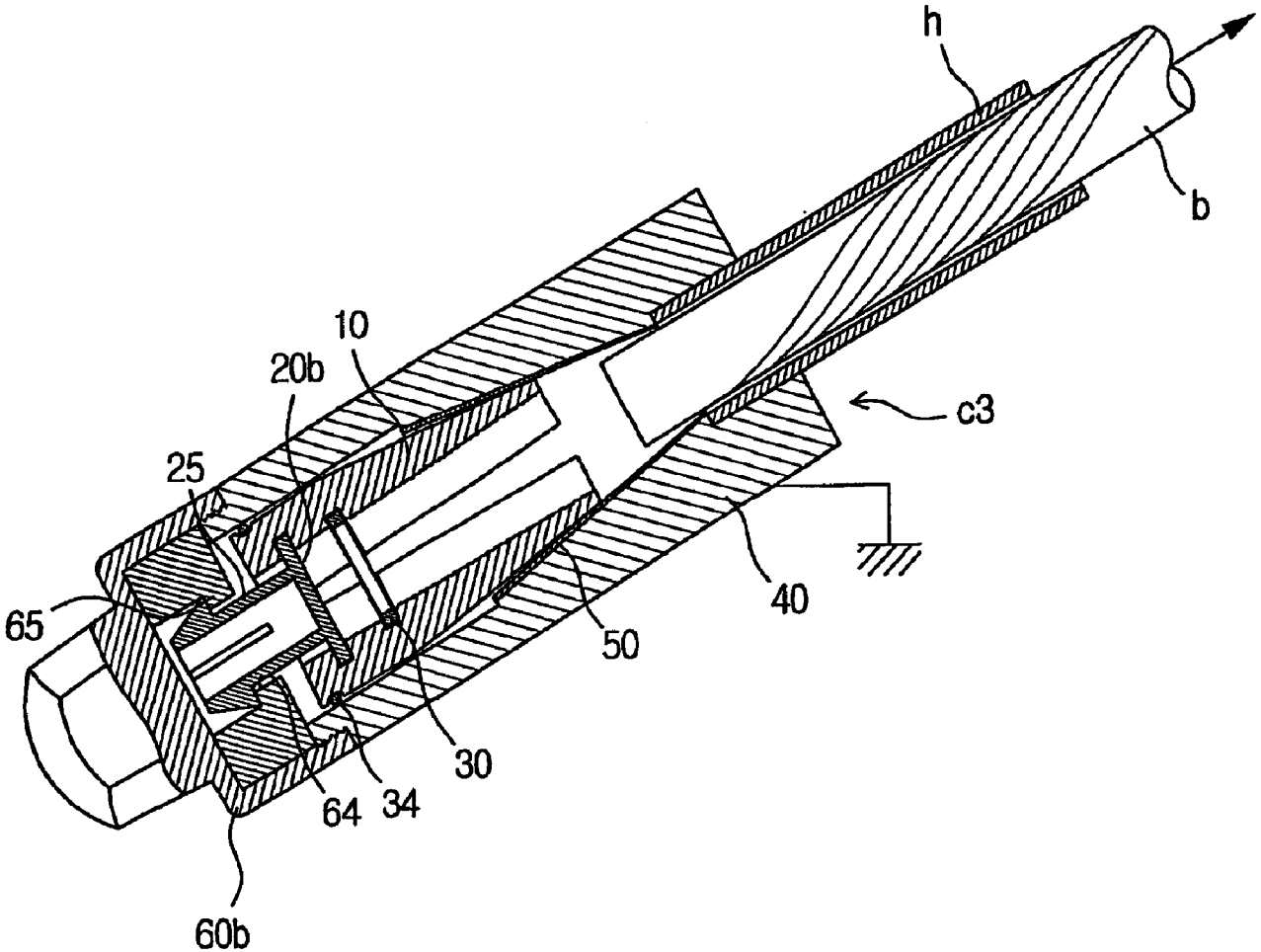
FIG. 22 is a cross-sectional view showing a condition of untying a wedge engagement by removal of an external anchoring of the tension member.

As shown in FIG. 22, at the moment of releasing of the external anchoring of the tension member b after the subsurface construction works, the tension member b is extruded into the end of the tension member b by a reaction force corresponding to the anchoring load imposed on the tension member b and pushes the wedge traction plate 20*b*. In this case, the wedge traction plate 20*b* pulls all of the wedges 10 at the same time. The elastic hook 25 of the wedge traction plate 20*b* passes through the hook hole 64 and is joined with the hook engagement jaw 65. However, if the elastic hook 25 does not reach the hook engagement jaw 65, the outer edge of the tension member b is compacted by a hammer, thereby engaging the hook 25 with the hook engagement jaw 65. When the wedge traction plate 20*b* pulls the wedges 10, the wedge expansion ring 30 expands all ofthe wedges 10 in the centrifugal direction. As a result of the aforementioned complex movements of several components, the tension member b is released from engagement with the wedges 10.

If the tension member b having the wedge engagement-released end is withdrawn, when the external terminal of the tension member, the tension member b comes out, but the wedges 10 and the wedge traction plate 20*b* are not withdrawn by the tension member b. Since the wedge engagement with the end of the tension member b is entirely released, the elastic hook 25 is joined with the hook engagement jaw 65 of the cap 60*b* and locks the wedge traction plate 20*b*, and the traction jaw 15 (FIG. 2) of the wedges 10 is engaged with the edge of the wedge traction plate 20*b*, even if the tension member b is withdrawn, the wedges 10 and the wedge traction plate 20*b* are not pulled by the tension member b.

Locking Ring-Safety Ring Type Internal Anchorage c4

Figure 23:
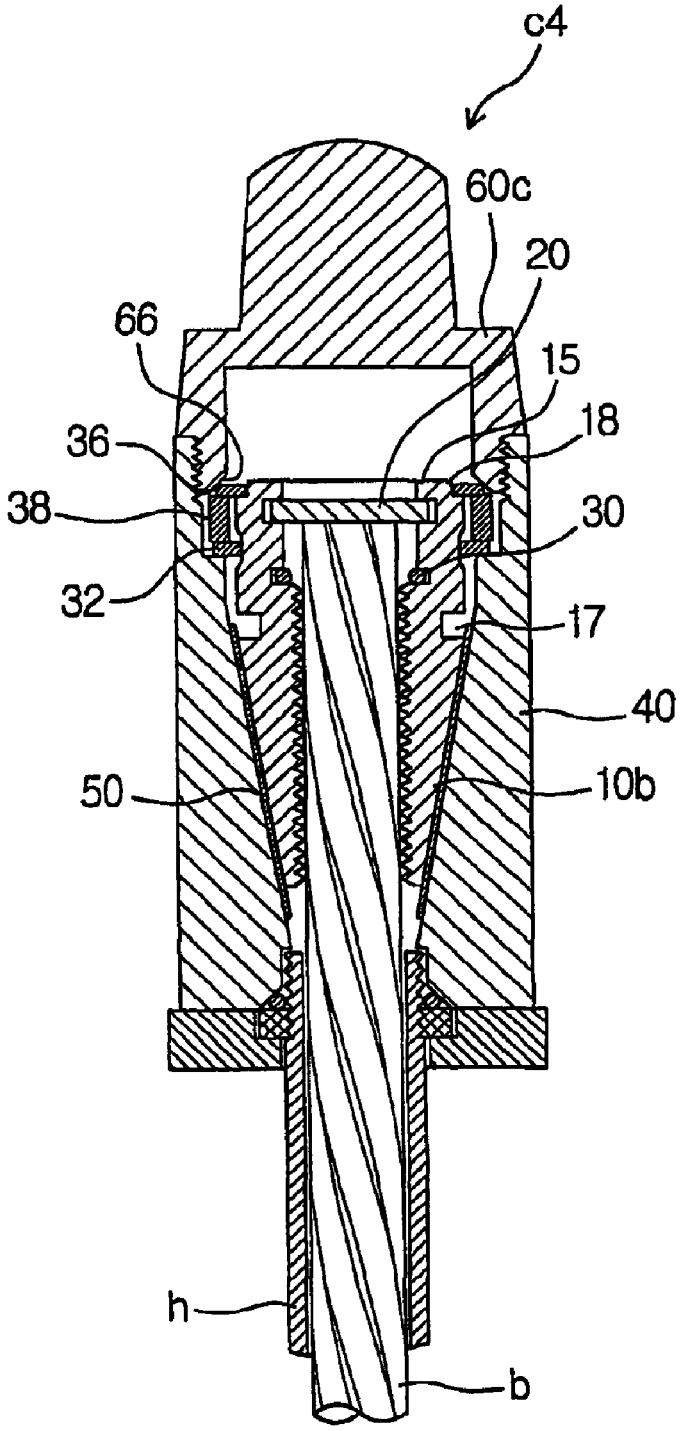
FIG. 23 is an assembled cross-sectional view of an internal anchorage employing a wedge provided with a locking ring and a stabilization ring.

As shown in FIG. 23, the locking ring-safety ring type internal anchorage c4 includes wedges 10*b* with ring horns 18 as a substitute for the wedges 10 of the aforementioned locking ring type internal anchorage c1. Additionally, the locking ring-safety ring type internal anchorage c4 further includes a wedge safety ring 36, a ring support 38, and a modified cap 60*c*. The wedge safety ring 36 is interposed between the front surface of the wedge locking ring 32, which is inserted into the ring horn 18 of the wedge 10*b* engaged with the end of the tension member, and is received on the ring seat 45 (FIG. 11) of the wedge box 40, and the inclined surface 66 (FIG. 23) of the cap 60*c*. Thereby, the interposed wedge safety ring 36, which is a metal C type ring, serves to fix the wedges 10*b*. The ring support 38 is a thick metal ring for stabilizing the interposed wedge safety ring 36 by supporting the outer edge of the back surface of the wedge safety ring 3 6 on the wedge locking ring 32 inserted into the outer ring groove 11 (FIG. 3) of the wedge 10*a*.

An inner edge of the back end of the cap 60*c* (FIG. 23) is the inclined surface 66. This inclined surface 66 is temporally fixed to the front edge of the wedge safety ring 36, the outer edge of which is inserted into the space with the ring support 38 on the wedge locking ring 32 on the ring seat 45 (FIG. 11) of the wedge box 40. Then, as the wedges 10*b* are withdrawn by the tension member b when the anchoring load is imposed on the tension member b of the internal anchorage c4, if the ring horn 18 is released from the wedge safety ring 36, the wedge safety ring 36 is elastically constricted so as to be easily removed from the space between the inclined surface 66 of the cap 60*c* and the wedge support 36. Therefore, when the wedges 10*b* are retroceded by the external anchoring-released tension member, the wedge safety ring 36 does not prevent the retroceding of the wedges 10*b*.

This internal anchorage c4 is manufactured in the same manner as the aforementioned locking ring type internal anchorage c1 from the step of assembling the wedge 10*b*, the wedge traction plate 20 and the wedge expansion ring 30 to the step of inserting the end of the tension member b covered by tube h into the tension member hole 42 (FIG. 11) of the wedge box 40 and engaging it to the wedge 10*b* (FIG. 23). A difference is that the steps of inserting the ring support 38 into the end of the wedge 10*b*, mounting it on the front surface of the wedge locking ring 32, and the inserting the wedge safety ring 36 into the ring horn 18 are added to the method of manufacturing the internal anchorage c4.

The cap 60*c* is formed on the end of the wedge box 40. Thereby, the back surface of the wedge safety ring 36 reaches the ring support 38, and the outer edge of the front surface of the wedge safety ring 36 is pressed by the inclined surface of the cap 60*c*. In this assembled internal anchorage c4, the wedge safety ring 36 blocks the front surface of the wedge 10*b* and prevents the retroceding of the wedge 10*b*. This alignment is maintained until the assembled internal anchorage c4 is inserted and anchored into the underground anchor hole ofthe construction field, and the tensile force is imposed on the tension member b. Thereby, since the wedge 10*b* engaged with the end of the tension member b is fixed and the wedge engagement is not loose, even by the impact and vibration imposed on the wedge 10*b* and the shaking of the tension member b during treating, the internal anchorage c4 has excellent assembly reliability. This excellent assembly reliability of the internal anchorage c4 improves construction quality of the ground anchor and eliminates the trouble of checking the wedge engagement of the wedge 10*b* with the end of the tension member b prior to inserting the internal anchorage c4 into the underground anchor hole.

Figure 24:
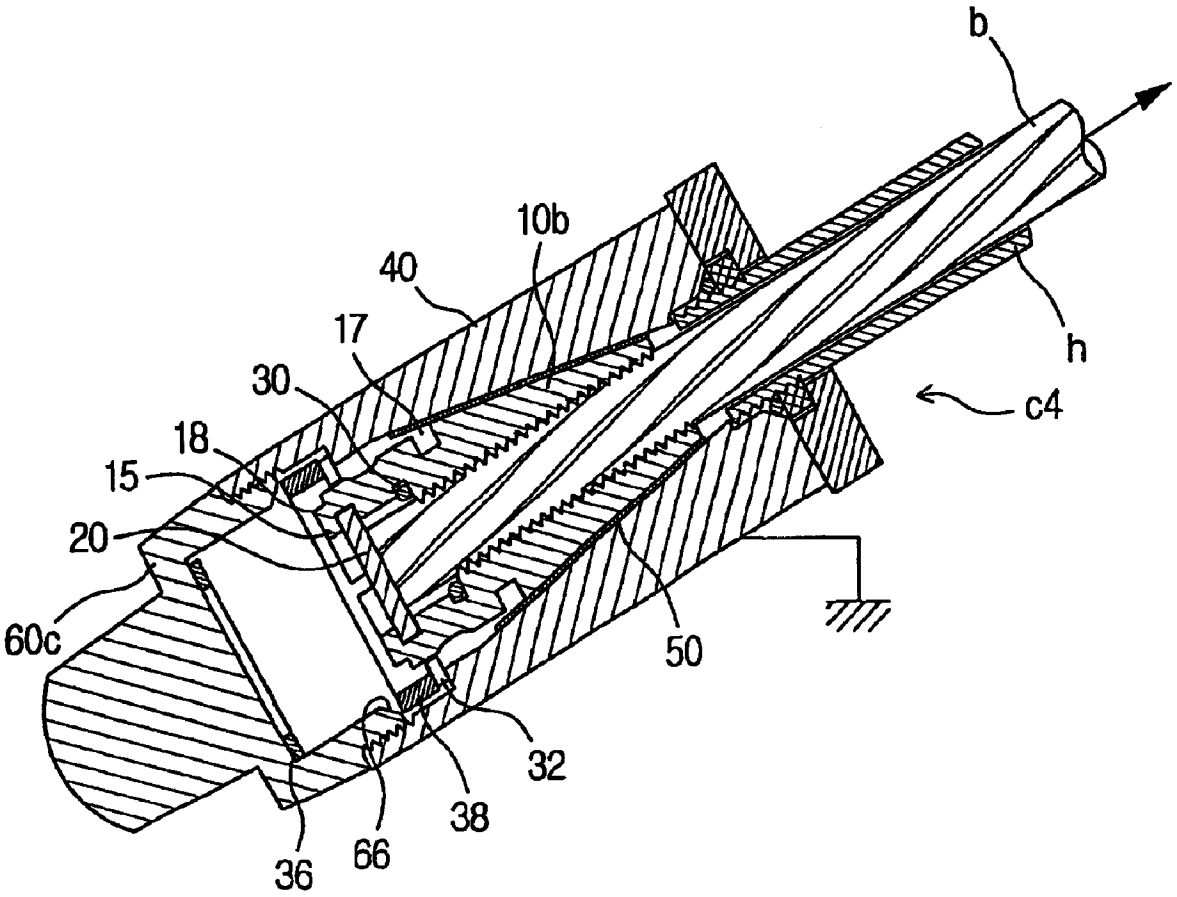
FIG. 24 is a cross-sectional view of imposing an anchorage load on the tension member.

As shown in FIG. 24, the internal anchorage c4 is inserted into the underground anchor hole d (FIG. 1) and the anchoring section is filled with the grout material e. If the anchorage load is imposed on the tension member b, only the wedges 10*b* within the wedge box 40 are drawn by the tension member b. The wedges 10*b* are constricted in the centripetal direction by the induction of the wedge seats 50 and more tightly constrict the tension member b. At a predetermined time, the ring horn 18 of the wedge 10*b* is removed from the wedge safety ring 36. The tension load limit of the strand wire used as the tension member b of the ground anchor is slightly more than 15 tons. However, the design anchoring load in using the strand wire as the tension member b of the ground anchor is approximately 11 to 12 tons. According to the test result, when the anchoring load is imposed on the tension member b, the ring horn 18 of the wedge 10*b* is removed from the wedge safety ring 26 at about 5.5 tons.

The wedge safety ring 36, from which the ring horn 18 as acting as an inner obstacle is removed, constricts by virtue of its elasticity and the force of the inclined surface 66 of the cap 60*c* in the centripetal direction, and the wedge safety ring 36 is removed by virtue of the gap between the cap 60*c* and the ring support 38. The removed wedge safety ring 36 falls into the bottom surface of the cap 60*c*. If the wedge safety ring 36 supporting the wedges 10*b* is removed, the wedges 10*b* cannot be retroceded when the external anchoring is released from the tension member b.

Figure 25:
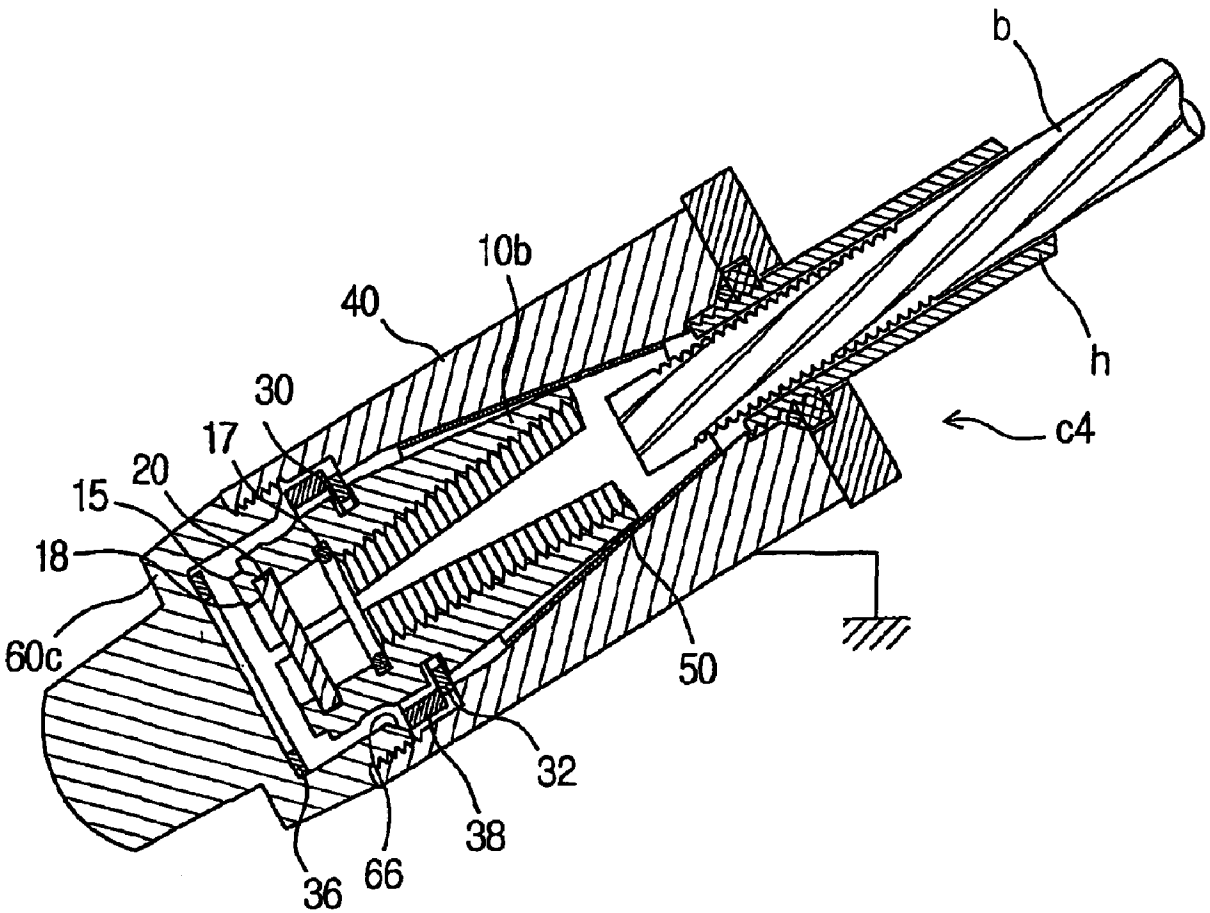
FIG. 25 is a cross-sectional view showing a condition of untying a wedge engagement by removal of an external anchoring of the tension member.

As shown in FIG. 25, the external anchoring is released from the tension member b. At this moment, the tension member b is extruded into the end by the reaction force corresponding to the anchoring load, and pulls the wedge traction plate 20. Then, the wedge traction plate 20 pulls all of the wedges 10*b* at one time. As the wedges 10*b* are moved to the end of the wedge box 40, the wedge locking ring 32 is released from the external ring groove 11, and the wedge expansion ring 20 expands all of the wedges 10*b* in the centrifugal direction. When the locking groove 17 of the wedge 10*b* coincides with the inner surface of the wedge locking ring 32, the wedge expansion ring 30 elastically constricts and locks the locking groove 17. Then, the wedges 10*b* are no longer retroceded. Herein, the wedges 10*b* are maximally expanded, thereby releasing the wedge engagement with the tension member b. The wedge engagement-released tension member b can be easily removed by pulling the external end of the tension member b by hand in the direction of the soil wall. Even if the wedge engagement-released tension member b is withdrawn, the wedges 10*b* are locked by the locking ring 32 and thus are not drawn by the tension member b.

Horn Screw-Safety Ring Type Internal Anchorage c5

Figure 26:
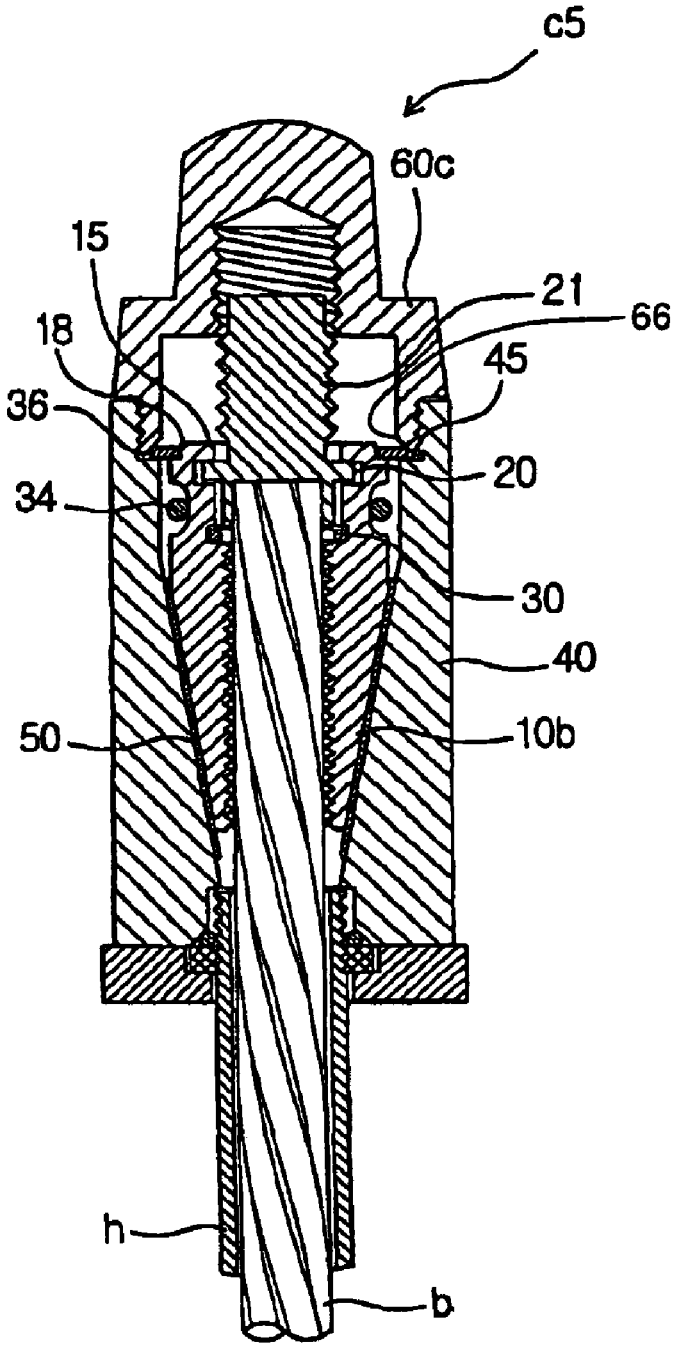
FIG. 26 is a cross-sectional view of an internal anchorage employing a horn screw-integrated wedge traction plate and a wedge provided with a stabilization ring.

As shown in FIG. 26, the horn screw-safety ring type internal anchorage c5 includes wedges 10*b* with ring horns 18 as a substitute for the wedges 10 of the aforementioned horn screw type internal anchorage c2. Additionally, the horn screw-safety ring type internal anchorage c5 further includes the wedge safety ring 36, and the modified cap 60*d*. Herein, the structures and functions of the wedge safety ring 36, the horn screw type traction plate 20, and the cap 60*c* with the inclined surface 66 are the same as those of the aforementioned embodiments. However, the position of the wedge safety ring 36 slightly differs from that of the aforementioned internal anchorage c4. That is, the wedge safety ring 36 inserted into the ring horn 18 of the wedge 10*b* is interposed between the ring seat 45 of the wedge box 40 and the inclined surface 66 of the cap 60, and is softly engaged thereto. In this case, considering the difference in the distance between ring seat 45 and the ring horn 18, the ring seat 45 is heightened by this difference, and thereby the wedge safety ring 36, interposed between the ring seat 45 and the inclined surface 66, coincides with the front end surface of the wedge 10*b*. That is, the position of the wedge safety ring 36 is stabilized.

Multi-Type Internal Anchorage c6

Each ofthe aforementioned internal anchorages c1 to c5 uses one strand of the tension member b. However, an internal anchorage for a large anchoring load requires a tension member with more than two strands. Thus, a multi-type internal anchorage c6 is described hereinafter.

Figure 27:
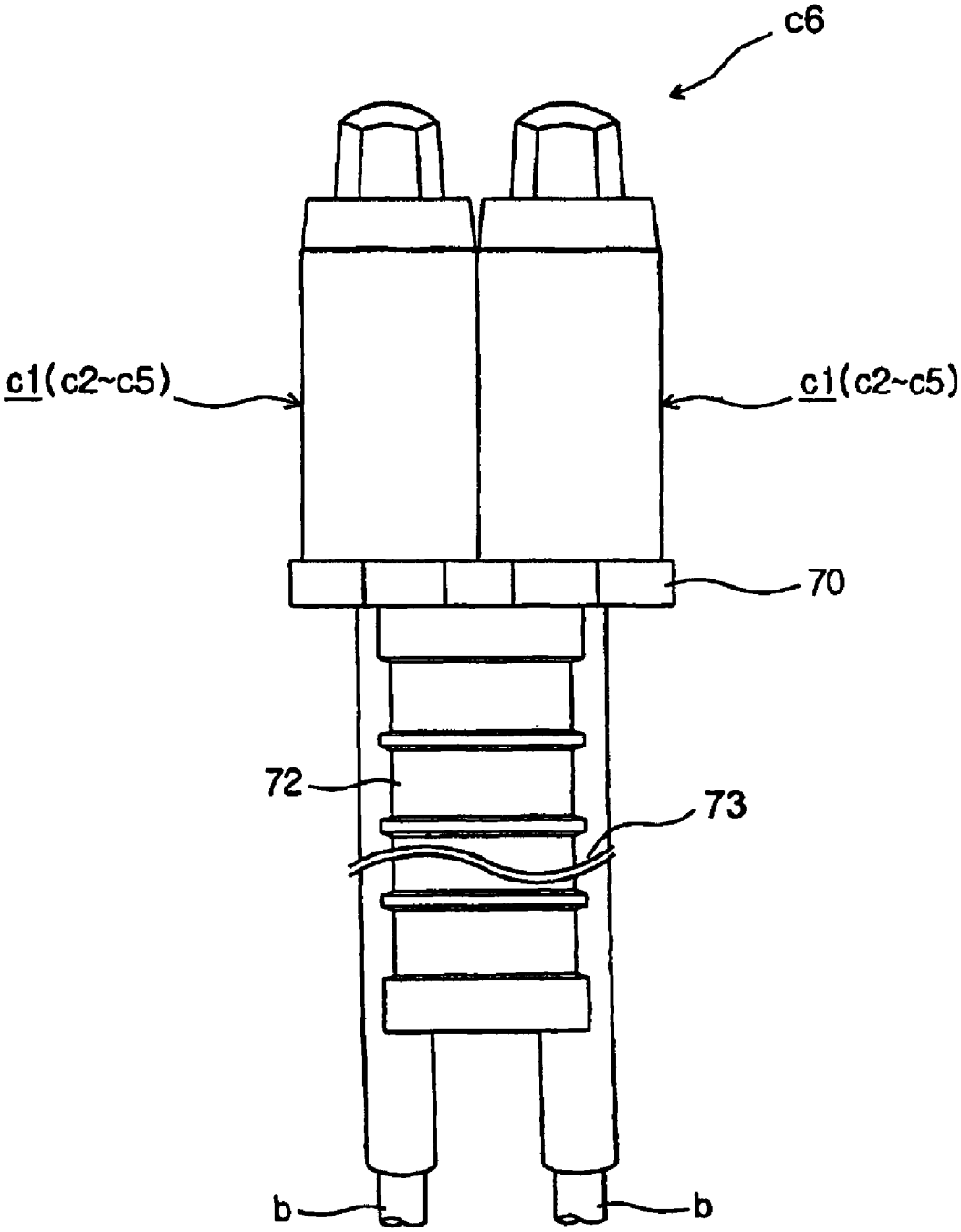
FIG. 27 is a partially exploded front view of a multi internal anchorage.
Figure 28:
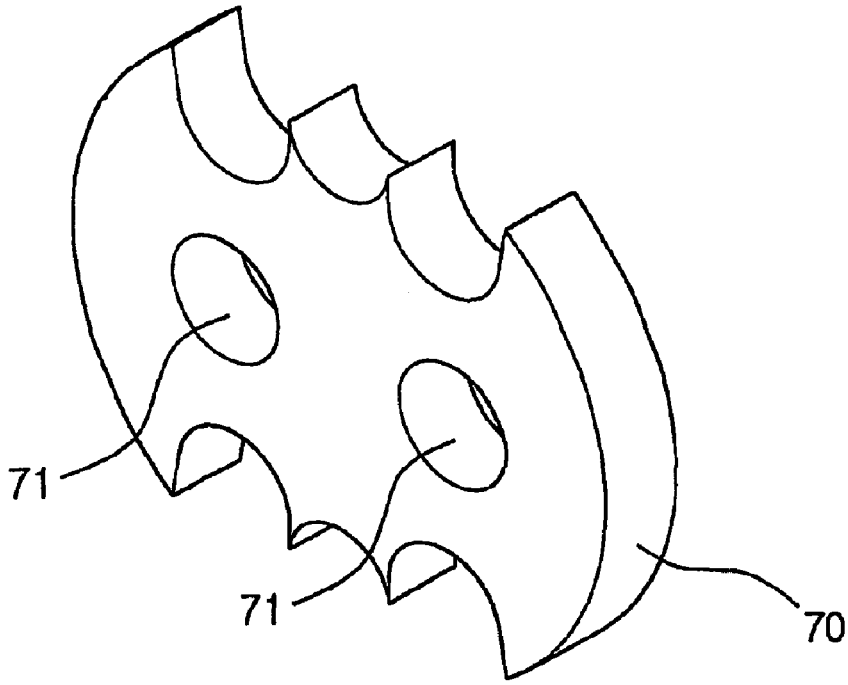
FIG. 28 is a perspective view of an auxiliary plate.

As shown in FIG. 27, the multi-type internal anchorage c6 includes two internal locking type internal anchorages c1 of the first embodiment of the present invention. If at least two internal anchorages c1 are assembled, as shown in FIG. 28, an auxiliary plate 70 with two tension member holes 71 for inserting the tension members b of the internal anchorages c1 is used. The auxiliary plate 70 has a considerably large thickness for preventing the warping or deformation of a load-withstanding member. Plural internal anchorages c1 are mounted on the auxiliary plate 70, and the tension member holes 42 (FIG. 11) of the wedge boxes 40 are fixed to the tension member holes 71 (FIG. 27) of the auxiliary plate 70. Then, the bottom surfaces of the wedge boxes 40 (FIG. 11) are attached to the auxiliary plate 70 (FIG. 27) by welding. In the same manner as in the aforementioned embodiments of the present invention, the ground anchor is assembled by inserting the end of each tension member b into the wedge 10 (FIG. 11) of each wedge box 40. The multi-type internal anchorage, including more than three internal anchorages, may be assembled by the same method. Herein, the reference numerals 72 and 73 represent the load withstanding member and the sealant, respectively.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Industrial Applicability

In accordance with the present invention, the internal anchorage wedge assembly is capable of removing the tension member of a ground anchor, the wedge assembly including at least one wedge and a wedge traction plate. At the moment that the external anchoring is released, the wedge traction plate pulls all of the wedges by means of a reaction force corresponding to the anchoring load imposed on the tension member, thereby releasing the engagement of the wedge(s) with the end of the tension member. Therefore, in the internal anchorage for removing the tension member of the ground anchor according to the present invention, the wedge engagement with the tension member is easily released.

Further, the internal anchorage for removing the tension member of the ground anchor includes the wedges, the wedge traction plate, a wedge expansion ring for expanding the wedges, wedge locking means for locking the retroceding wedges by means of the reaction force of the external anchoring-released tension member, thereby preventing the withdrawal of the wedge when the wedge engagement-released tension member is withdrawn, a wedge box with wedge seats, a wedge separation layer for preventing the attachment of the wedge to the wedge seat, and a cap formed on the end of the wedge box and acting to protect the inner components. In accordance with the invention, the tension member is easily removed by releasing the external anchoring of the tension member without removing other equipment, such as a drawbench.

Moreover, the internal anchorage for removing the tension member of the ground anchor further includes wedges with ring horns on their end, and a wedge safety ring inserted into the ring horns. The wedges engaged with the end of the tension member are fixed, and the wedge engagements do not become loose but are stabilized even in the presence of impact and vibration imposed on the wedges and shaking of the tension member during treating. The trouble of checking the wedge engagement of the wedge with the end of the tension member prior to inserting the internal anchorage into the underground anchor hole is eliminated.

What is claimed is:

1. An internal anchorage wedge assembly for removing a tension member of a ground anchor, said wedge assembly comprising:

spiral engagement teeth formed on an inner surface of a wedge; and an elastic ring mounted on an outer surface of the wedge in order to maintain an assembled condition of the wedge;

wherein a front inner surface of the wedge is a smooth surface without engagement teeth, a traction jaw for mounting a wedge traction plate is formed on the smooth surface in a circumferential direction, and an internal ring groove for receiving a wedge expansion ring is formed on a back surface of the traction jaw.

2. The internal anchorage wedge assembly for removing a tension member of a ground anchor as claimed in claim 1, wherein the wedge has a locking groove formed therein for engagement with a wedge locking ring when the wedge is retroceded into a back of an external ring groove.

3. The internal anchorage wedge assembly for removing a tension member of a ground anchor as claimed in claim 2, wherein the wedge further comprises a ring horn for receiving a wedge safety ring, said ring horn being formed on an end of the wedge.

4. The internal anchorage wedge assembly for removing a tension member of a ground anchor as claimed in claim 1, wherein the wedge traction plate comprises a horn screw engaged with a screw hole of a cap, said horn screw being formed on a center of a front surface of the wedge traction plate.

5. The internal anchorage wedge assembly for removing a tension member of a ground anchor as claimed in claim 1, wherein the wedge traction plate comprises an elastic hook inserted into a hook hole of a cap and locked by a hook engagement jaw, said elastic hook being formed on a center of a front surface of the wedge traction plate.

6. An internal anchorage of a locking ring type for removing a tension member of a ground anchor, said internal anchorage comprising:

a wedge including an external ring groove formed on an external surface of the wedge, a traction jaw and an internal ring groove formed on an internal surface of the wedge, engagement teeth formed on a back of the internal surface, and a locking groove formed on the back external surface adjacent to the external ring groove;

a wedge traction plate engaged to a traction jaw of the wedge for pulling the wedge by means of a reaction force when external anchoring is being released;

a wedge expansion ring inserted into the internal ring groove for expanding the wedge;

a wedge box including a tension member hole formed on a back end thereof, a tube seat for inserting and fixing a tube disposed on the tension member, said tube seat being formed around the tension member hole, and a wedge seat for the wedge and a ring seat for a locking ring formed on the internal surface;

a wedge separation layer interposed between the wedge seat and the wedge;

a cap covering a front end of the wedge box for protecting components of the wedge box; and a wedge locking ring formed between the ring seat of the wedge box and a back end of the cap for locking the locking groove of the wedge when retroceding.

7. An internal anchorage of a horn screw type for removing a tension member of a ground anchor, said internal anchorage comprising:

a wedge including an external ring groove formed on an external surface of the wedge, a traction jaw and an internal ring groove formed on an internal surface of the wedge, and engagement teeth formed on a back of the internal surface;

a wedge traction plate having a horn screw formed on a center of a front surface thereof, said wedge traction plate being connected to the traction jaw for pulling the wedge by means of a reaction force when external anchoring is being released;

a wedge expansion ring inserted into the internal ring groove for expanding the wedge;

a wedge box including a tension member hole formed on a back end thereof, a tube seat for inserting and fixing a tube disposed on the tension member, said tube seat being formed around the tension member hole, and a wedge seat for the wedge and a ring seat for a locking ring formed on the internal surface;

a wedge separation layer interposed between the wedge seat and the wedge; and a cap having a screw hole for engagement with the horn screw, said cap covering a front end of the wedge box for protecting components of the wedge box.

8. An internal anchorage of an elastic hook type for removing a tension member of a ground anchor, said internal anchorage comprising:

a wedge including an external ring groove formed on an external surface of the wedge, a traction jaw and an internal ring groove formed on an internal surface of the wedge, and engagement teeth formed on a back of the internal surface;

a wedge expansion ring inserted into the internal ring groove for expanding the wedge;

a wedge box including a tension member hole formed on a back end thereof, a tube seat for inserting and fixing a tube disposed on the tension member, said tube seat being formed around the tension member hole, and a wedge seat for the wedge and a ring seat for a locking ring formed on the internal surface;

a wedge traction plate having an elastic hook formed on a center of a front surface thereof, said wedge traction plate being connected to the traction jaw for pulling the wedge by means of a reaction force when external anchoring is being released;

a wedge separation layer interposed between the wedge seat and the wedge; and a cap having a hook hole and a hook engagement jaw for engagement with the elastic hook, said cap covering a front end of the wedge box for protecting components of the wedge box;

wherein the elastic hook of the wedge traction plate and a screw hole of the cap are used as retroceding wedge locking means.

9. An internal anchorage of a locking ring-safety ring type for removing a tension member of a ground anchor, said internal anchorage comprising:

a wedge including an external ring groove formed on an external surface of the wedge, a traction jaw and an internal ring groove formed on an internal surface of the wedge, engagement teeth formed on a back of the internal surface, a locking groove formed adjacent to the external ring groove, and a ring horn for a wedge safety ring formed on a front end of the wedge;

a wedge expansion ring inserted into the internal ring groove for expanding the wedge;

a wedge box including a tension member hole formed on a back end thereof, a tube seat for inserting and fixing a tube disposed on the tension member, said tube seat being formed around the tension member hole, and a wedge seat for the wedge and a ring seat for a locking ring formed on the internal surface;

a wedge traction plate connected to a traction jaw for pulling the wedge by means of a reaction force when external anchoring is being released;

a cap covering a front end of the wedge box for protecting components of the wedge box, an inner edge of a back end of said cap being an inclined surface;

a wedge locking ring formed between the ring seat of the wedge box and the back end of the cap for locking the locking groove of the wedge when retroceding;

a wedge separation layer interposed between the wedge seat and the wedge;

a wedge safety ring inserted into the ring horn for stabilizing the wedge on the wedge seat; and a ring stand for supporting the wedge safety ring between the wedge locking ring and the back end of the cap.

10. An internal anchorage of a horn screw-safety ring type for removing a tension member of a ground anchor, said internal anchorage comprising:

a wedge including an external ring groove formed on an external surface of the wedge, a traction jaw and an internal ring groove formed on an internal surface of the wedge, engagement teeth formed on a back of the internal surface, and a ring horn for a wedge safety ring formed on a front end of the wedge;

a wedge expansion ring inserted into the internal ring groove for expanding the wedge;

a wedge box including a tension member hole formed on a back end thereof, a tube seat for inserting and fixing a tube disposed on the tension member, said tube seat being formed around the tension member hole, and a wedge seat for the wedge and a ring seat for a locking ring formed on the internal surface;

a wedge traction plate having a horn screw formed on a center of a front surface thereof, said wedge traction plate being connected to the traction jaw for pulling the wedge by means of a reaction force in when the external anchoring is being released;

a cap having a screw hole for engagement with the horn screw, said cap covering a front end of the wedge box for protecting components of the wedge box, an inner edge of a back end of said cap being an inclined surface; and a wedge safety ring inserted into the ring horn and supported between the ring seat of the wedge box and the inclined surface of the cap, for stabilizing the wedge.

* * * * *